US007174941B2

(12) United States Patent
Schroder et al.

(10) Patent No.: US 7,174,941 B2
(45) Date of Patent: Feb. 13, 2007

(54) ONE-WAY DRIVE FOR WINDOW COVERINGS

(75) Inventors: Paul D. Schroder, Pella, IA (US); Gabriel P. Gromotka, Pella, IA (US)

(73) Assignee: Pella Corporation, Pella, IA (US)

( * ) Notice: Subject to any disclaimer, the term of this patent is extended or adjusted under 35 U.S.C. 154(b) by 0 days.

(21) Appl. No.: 11/214,493

(22) Filed: Aug. 29, 2005

(65) Prior Publication Data

US 2005/0284584 A1 Dec. 29, 2005

Related U.S. Application Data

(60) Division of application No. 10/437,773, filed on May 14, 2003, now Pat. No. 7,021,360, which is a continuation-in-part of application No. 10/200,579, filed on Jul. 22, 2002, now Pat. No. 6,736,185.

(51) Int. Cl.
*E06B 3/32* (2006.01)

(52) U.S. Cl. ..... 160/168.1 P; 160/107

(58) Field of Classification Search ..... 160/171, 160/170, 168.1 P, 176.1 P, 84.02, 188, 201; 192/69.7, 94, 150
See application file for complete search history.

(56) References Cited

U.S. PATENT DOCUMENTS

| | | | |
|---|---|---|---|
| 16,741 | A | 3/1857 | Miles |
| 16,989 | A | 4/1857 | Miles |
| 1,615,632 | A | 1/1927 | Kennear |
| 1,993,173 | A | 3/1935 | Kuyper |
| 2,209,384 | A | 7/1940 | Brown |
| 2,301,150 | A | 11/1942 | Sienicki |
| 2,430,579 | A | 11/1947 | Nelson |
| 2,534,777 | A | 12/1950 | Kesner |
| 2,758,644 | A | 8/1956 | Virtouvet |
| 3,080,620 | A | 3/1963 | Mendelsohn |
| 3,366,159 | A | 1/1968 | Arnold et al. |
| 3,389,737 | A | 6/1968 | Arnold et al. |
| 3,466,806 | A | 9/1969 | Teggelaar et al. |
| 3,788,006 | A | 1/1974 | Teggelaar et al. |
| 4,015,367 | A | 4/1977 | DeBruyn |
| 4,191,237 | A | 3/1980 | Voege |
| 4,193,438 | A | 3/1980 | Pastore |
| 4,373,295 | A | 2/1983 | Starck |
| 4,522,244 | A | 6/1985 | Brolin |
| 4,570,382 | A | 2/1986 | Suess |
| 4,571,887 | A | 2/1986 | Haltof |
| 4,606,147 | A | 8/1986 | DeWitt et al. |
| 4,621,673 | A | 11/1986 | Georgopoulos et al. |
| 4,664,169 | A | 5/1987 | Osaka et al. |

(Continued)

FOREIGN PATENT DOCUMENTS

| | | |
|---|---|---|
| EP | 0 235 952 | 9/1987 |

*Primary Examiner*—Blair M. Johnson
(74) *Attorney, Agent, or Firm*—Faegre & Benson LLP

(57) ABSTRACT

An actuation system for use with an adjustable covering for a fenestration product. The actuation system coupled to an operator for controlling adjustment of extension and contraction of the covering. The actuation system including at least one lift mechanism configured to decouple the actuation system from the operator during a potentially damaging event, such as slack in a lift cord during extension of the covering. The lift mechanism later recoupling the actuation system and operator while maintaining rotational registration between multiple lift mechanisms of the actuation system.

22 Claims, 27 Drawing Sheets

U.S. PATENT DOCUMENTS 4,685,502 A 8/1987 Spangenberg
4,687,040 A 8/1987 Ball
4,763,447 A 8/1988 Haltof et al.
4,779,380 A 10/1988 Westfall
4,817,698 A 4/1989 Rossini et al.
4,850,416 A 7/1989 Evers
4,886,103 A 12/1989 Baier
4,902,953 A * 2/1990 Kraft et al. ..... 318/663
4,913,213 A 4/1990 Schnelker
4,934,438 A 6/1990 Yuhas et al.
4,949,506 A 8/1990 Durham, Jr.
5,000,242 A 3/1991 Coddens
5,033,235 A 7/1991 Stark
5,036,622 A 8/1991 Stark
5,103,888 A * 4/1992 Nakamura ..... 160/171
5,117,586 A 6/1992 Stark
5,123,472 A * 6/1992 Nagashima et al. ..... 160/170
5,174,064 A 12/1992 Stark
5,184,660 A 2/1993 Jelic
5,207,025 A 5/1993 Westfall
5,226,466 A 7/1993 Coddens
5,379,825 A 1/1995 Jelic
5,414,960 A 5/1995 O'Donnell et al.
5,611,381 A 3/1997 Jelic
5,628,356 A 5/1997 Marocco
5,706,875 A * 1/1998 Simon ..... 160/8
5,787,953 A 8/1998 Jacobson
5,803,148 A * 9/1998 Madsen ..... 160/176.1 R
RE35,926 E 10/1998 Hagen
5,927,364 A 7/1999 Zacher et al.
5,927,370 A 7/1999 Judkins
5,934,351 A 8/1999 Bharucha et al.
5,996,668 A 12/1999 DeBlock et al.
6,006,813 A 12/1999 Jelic
6,056,036 A 5/2000 Todd et al.
6,059,004 A 5/2000 Oskam
6,070,638 A 6/2000 Jelic
6,119,755 A 9/2000 Oskam
6,129,131 A 10/2000 Colson
6,155,328 A 12/2000 Welfonder
6,158,563 A 12/2000 Welfonder et al.
6,216,392 B1 4/2001 DiGinosa
6,223,802 B1 5/2001 Colson
6,325,131 B1 12/2001 Dekker et al.
6,328,090 B1 12/2001 Anderson et al.
6,388,404 B1 5/2002 Schnebly et al.
6,443,210 B1 9/2002 Welfonder
6,550,522 B1 4/2003 Lennon et al.
6,708,750 B2 * 3/2004 Collett et al. ..... 160/84.02
6,736,185 B2 5/2004 Smith et al.
2003/0066614 A1 4/2003 Sun et al.

* cited by examiner

ONE-WAY DRIVE FOR WINDOW COVERINGS

This application is a divisional application of co-pending U.S. patent application Ser. No. 10/437,773, filed on May 14, 2003 and entitled ONE-WAY DRIVE FOR WINDOW COVERINGS, which was a continuation-in-part of U.S. Pat. No. 6,736,185, filed on Jul. 22, 2002 and entitled SLIDING OPERATOR FOR BETWEEN THE GLASS WINDOW COVERINGS, both of which are herein incorporated by reference.

FIELD OF THE INVENTION

The present invention relates to an actuation system for a fenestration product adjustable covering, including a one-way drive mechanism used to reduce damage to the system due to a potentially damaging event during extension of the covering.

BACKGROUND OF THE INVENTION

Within the art of fenestration products, such as windows and doors, it is well known that double panes of glass in a window provide better insulation than a single pane of glass. The provision of venetian type blinds or pleated shades between two panes of glass in a fenestration product is also known in the art to provide desired window or door coverage. A pleated blind between window panes is disclosed in the U.S. Pat. No. 4,913,213 to Schnelker. A venetian or slat blind between panes of glass is disclosed in the U.S. Pat. Nos. 4,687,040; 4,664,169 and 5,379,825. In order to utilize such blinds or shades effectively with the increased insulation of the double glass product, control mechanisms for lifting, lowering and tilting the blind or shade from one side of the window must be provided while maintaining the window seal. The art has provided cords and cables, sometimes driven by a motor or gear system, as the control mechanism. The most popular systems route the cord through an aperture drilled through the interior pane of glass.

U.S. Pat. No. 4,687,040 to Ball discloses a device for adjusting the tilt angle of slats of a slat blind positioned between the panes of glass. The device includes a hole in one pane of glass and a flexible cable passing through the hole. The cable is connected to a rectangular member which controls the rotation of the slats. When the cable is turned by external torque, the slats are tilted.

U.S. Pat. No. 4,913,213 discloses a pleated blind between double window panes and blind control means for raising and lowering the blind. One embodiment is comprised of an aperture in one pane of glass and a bolt with a center hole mounted in the aperture. An actuator cord passes through the bolt hole and further up and over a screen, if desired, thereby providing an external control mechanism.

U.S. Pat. No. 5,379,825 discloses a window blind between double panes of glass. One embodiment uses a lift cord and a control cord routed through a hollow screw passing through one of the panes of glass to provide external control of the blind.

The prior art has also developed more complicated control mechanisms that utilize cables and gear systems that pass through the window frame rather that the glass. U.S. Pat. No. 4,664,169 to Osaka et al. discloses a device for tilting slats of a venetian blind between double panes of glass. The device uses electrical power driving means to move a piezoelectric bimorph device in a horizontal plane. The piezoelectric bimorph device is mounted to a block having a threaded bore. The piezoelectric bimorph device mechanically moves an elongated V-shaped beam under two cross arms which control the rotation of the slats. When the beam is moved, the cross arms are tilted, thereby rotating the slats.

The complicated systems that require control mechanisms to be mounted in or routed through the window frame are relatively expensive to manufacture. Furthermore, in many of these systems gears and motors wear and then slip or fail. Many of these control devices require a head rail which is too wide to fit between the panes of those windows whose panes are not more than ¾ inches apart. Hence, these systems have never achieved the popularity of through the glass systems.

The problems of the prior art systems discussed above are not present if the control mechanism is a cord or cords routed between the edge of the interior glass panel and the window frame. In U.S. Pat. No. 4,913,213, Schnelker describes a pleated blind between window panes. In one preferred embodiment, the actuator cord is routed over the glass housing and any screen housing provided. An L-shaped guide having a single vertical and horizontal channel cut therein is fitted over the top edge of the glass housing. An actuator cord passes through the channel. A major problem with this system is that one cannot maintain a seal between the window frame and the edge of the glass housing. Another problem is that most blinds have four control cords, two lift cords and two tilt cords. If all four cords are routed through a single channel they tend to bind and interfere with one another.

In U.S. Pat. Nos. 5,611,381, 6,006,813 and 6,070,638, Jelic describes a window having a blind between two panes of glass. A cord guide is provided at the top edge of the housing, with the cord guide including multiple slots for the lift and tilt cords. The cord guide maintains a seal between the window frame and the window panes and keeps the cords separated. However, in this window system, the blind is still controlled by multiple cords routed around the window panes, which still tend to present problems for the user.

Even when the cord routing has been improved, between the glass window covering product may still have problems, such as jamming, when the lift cords experience slack during operation. These problems may occur when the lift mechanism is used too briskly or quickly, or when the window covering encounters some type of obstruction. With the blind located between two glass panels, resolution of a jam in the lift cord is not an easy matter. Therefore, lift cord systems and blind actuation mechanisms that reduce the risk of slack and jamming are preferred.

BRIEF SUMMARY OF THE INVENTION

The present invention provides a covering actuation system for an adjustable covering used with a fenestration product. The covering actuation system is configured to extend and contract the covering upon operation of a covering operator by a user to provide varying amounts of viewing coverage through the fenestration product. The covering actuation system includes a lift mechanism coupled to the operator such that operation of the operator by a user results in the extension and contraction of the covering by action of the lift mechanism. The lift mechanism also includes a drive system configured to temporarily decouple and later recouple the lift mechanism from the operator. The drive system is activated by a potentially damaging event during extension of the covering so as to reduce damage to the lift mechanism. The potentially damaging event may include slack in a lift cord during extension of the covering. The drive system is configured to retain rotational registration between multiple lift mechanisms of the covering actuation system upon recoupling of the lift mechanism to the operator.

DETAILED DESCRIPTION OF THE INVENTION

Figure 1:
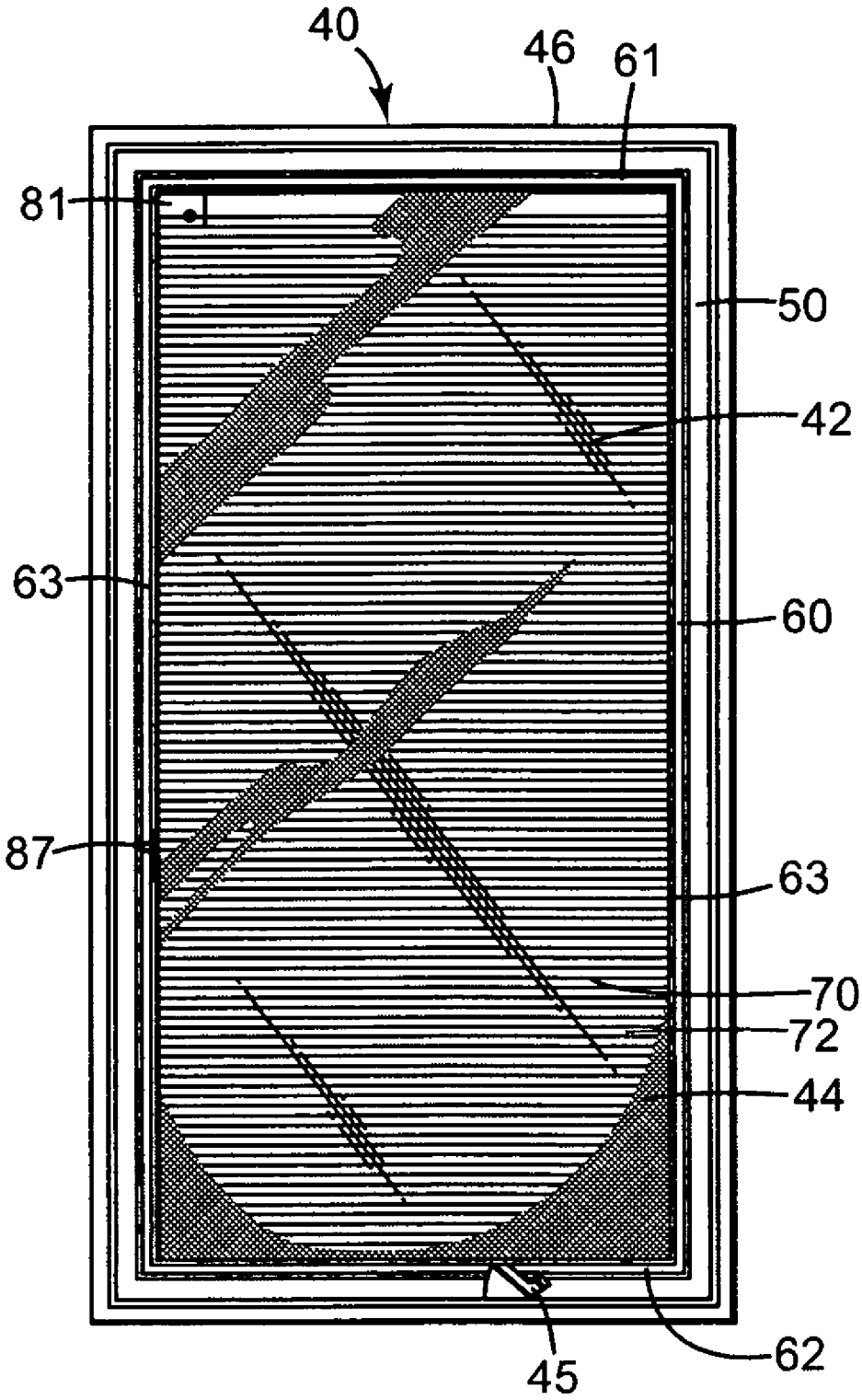
FIG. 1 is a front, interior view of a fenestration product, such as a window, including a between the glass window covering and an interior insect screen.
Figure 2:
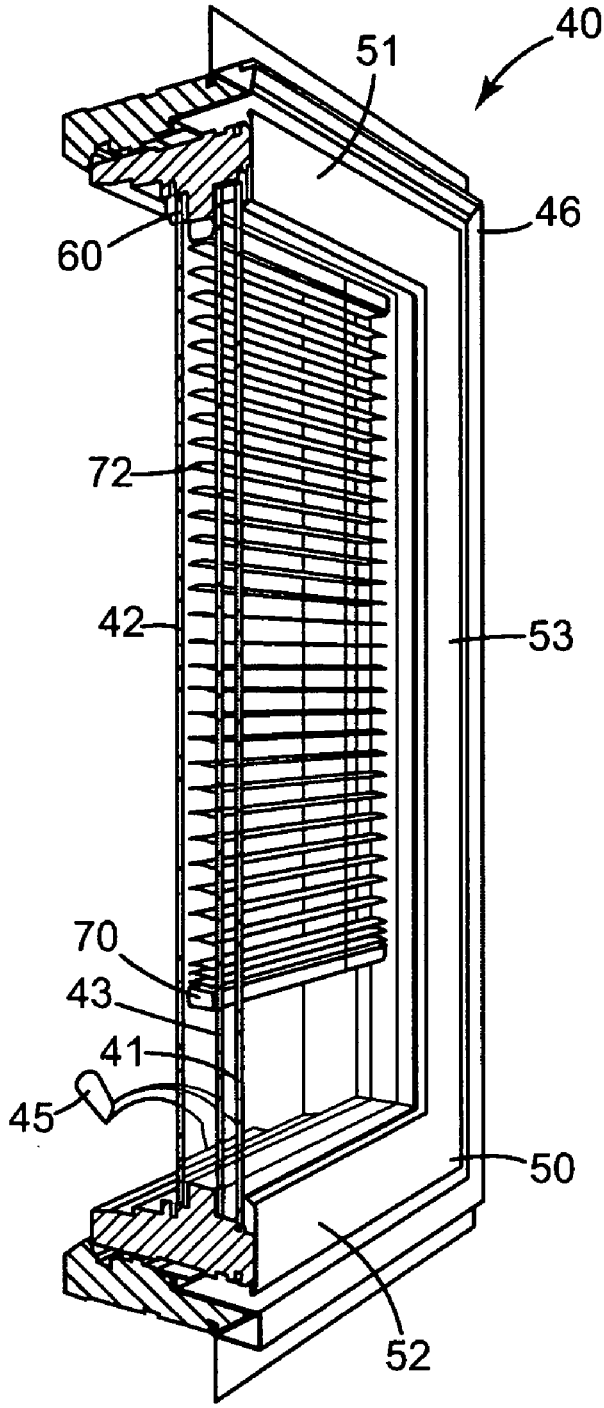
FIG. 2 is a partial detail view of the window of FIG. 1.

With reference to the attached Figures, it is to be understood that like components are labeled with like numerals throughout the several Figures. FIGS. 1 and 2 are a fenestration product 40 to be used in accordance with the present invention having multiple panes of viewing material, including an exterior pane 41 and an interior pane 42, and an optional interior insect screen 44, all set within a window frame 46. One or more additional panes of viewing material, such as double pane 43, may also be provided as needed to meet the efficiency and esthetic requirements of the fenestration product 40. As used herein, the term "viewing material" refers to organic or inorganic materials that provide at least a partial barrier to the elements through which light can pass, including for example glass, plexiglass, screening materials, and the like. The viewing materials can be transparent, translucent, or partially opaque. Due to long-standing usage in the art, the terms "glass" and "pane" are synonymous with the term viewing material.

The panes of viewing material 41, 42, 43 are mounted within a sash 50 having a sash head 51, a sash sill 52 and sash jambs 53. The sash 50 is moveable to open the fenestration product 40 to allow for air flow into a building in which the fenestration product 40 is mounted. A handle 45 is commonly used to open and close the sash 50, when desired. Positioned between the exterior and interior panes of viewing material, 41 and 42, respectively, is a window covering 70 that may be adjusted by extending or contracting the covering 70 and/or by tilting components, such as slats 72, of the covering 70. Although the disclosed primarily between two sheets of viewing material, the present window covering 70 can also be used on the interior side of a fenestration product 40 adjacent a single pane of viewing material.

Although shown as a casement window, the fenestration product 40 may be any of a number of types products having windows, including but not limited to openable and non-openable windows, double-hung windows, windows within doors, sliding glass or patio doors, or other windows now known or later developed to be mounted in an architectural opening within a building. Although shown as a horizontal slat blind, it is to be understood that the window covering 70 may be any of a number of types of window coverings, including but not limited to horizontal blinds, vertical blinds, or other types of blinds, roman shades, pleated shades, honeycomb shades or other types of shades, any of which are capable of being extended and/or contracted to provide a desired amount of coverage for the window, and may be adjusted by tilting slats or other components of the covering. The window covering may be constructed from materials that are opaque, partially opaque, or translucent. For certain applications, the window covering may be constructed from a transparent material that is treated to block certain wavelengths of electromagnetic radiation, such as ultraviolet.

Figure 3:
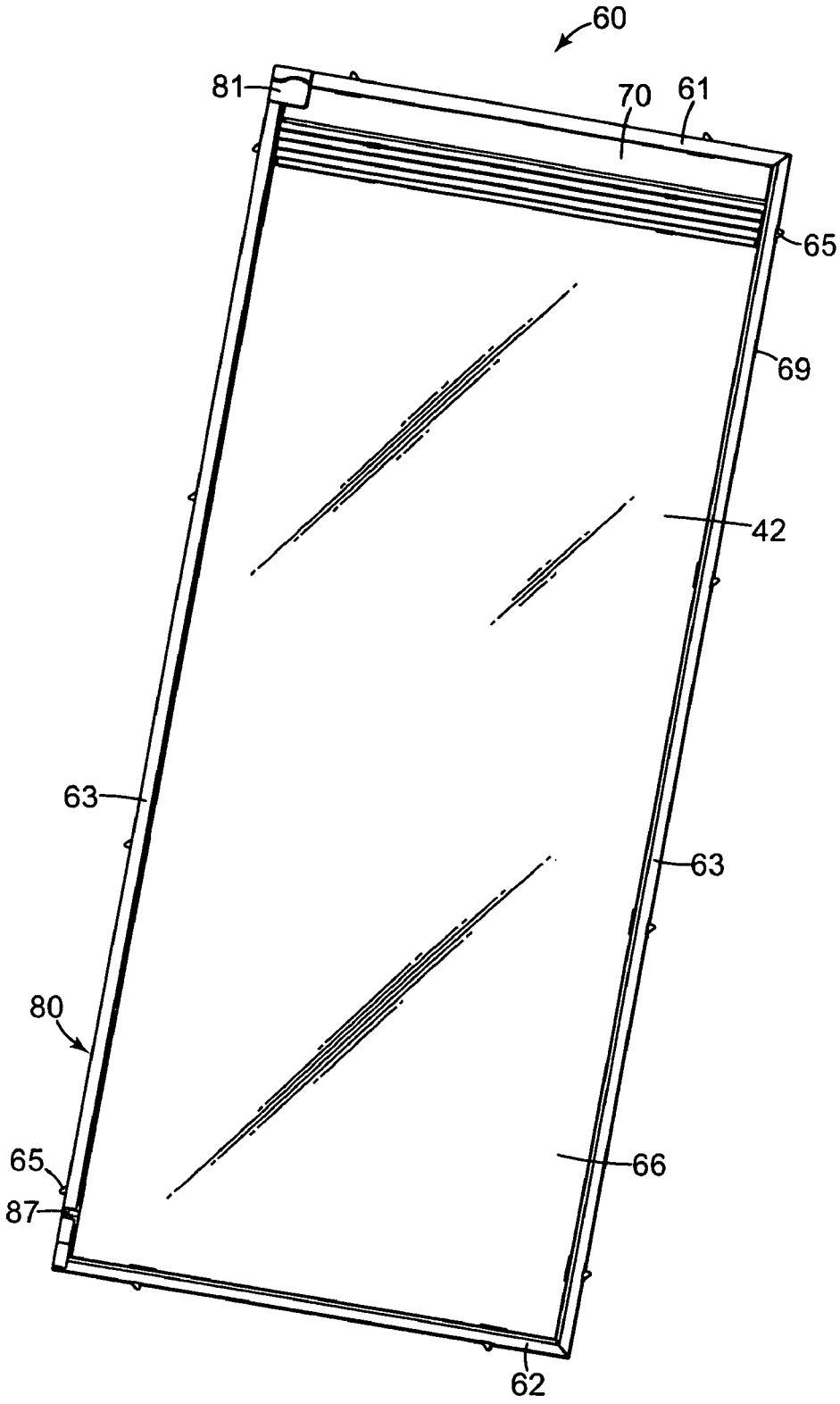
FIG. 3 is a front, interior view of a window panel removed from a window frame, including one embodiment of a sliding operator for a between-the-glass window covering in accordance with the present invention.
Figure 4:
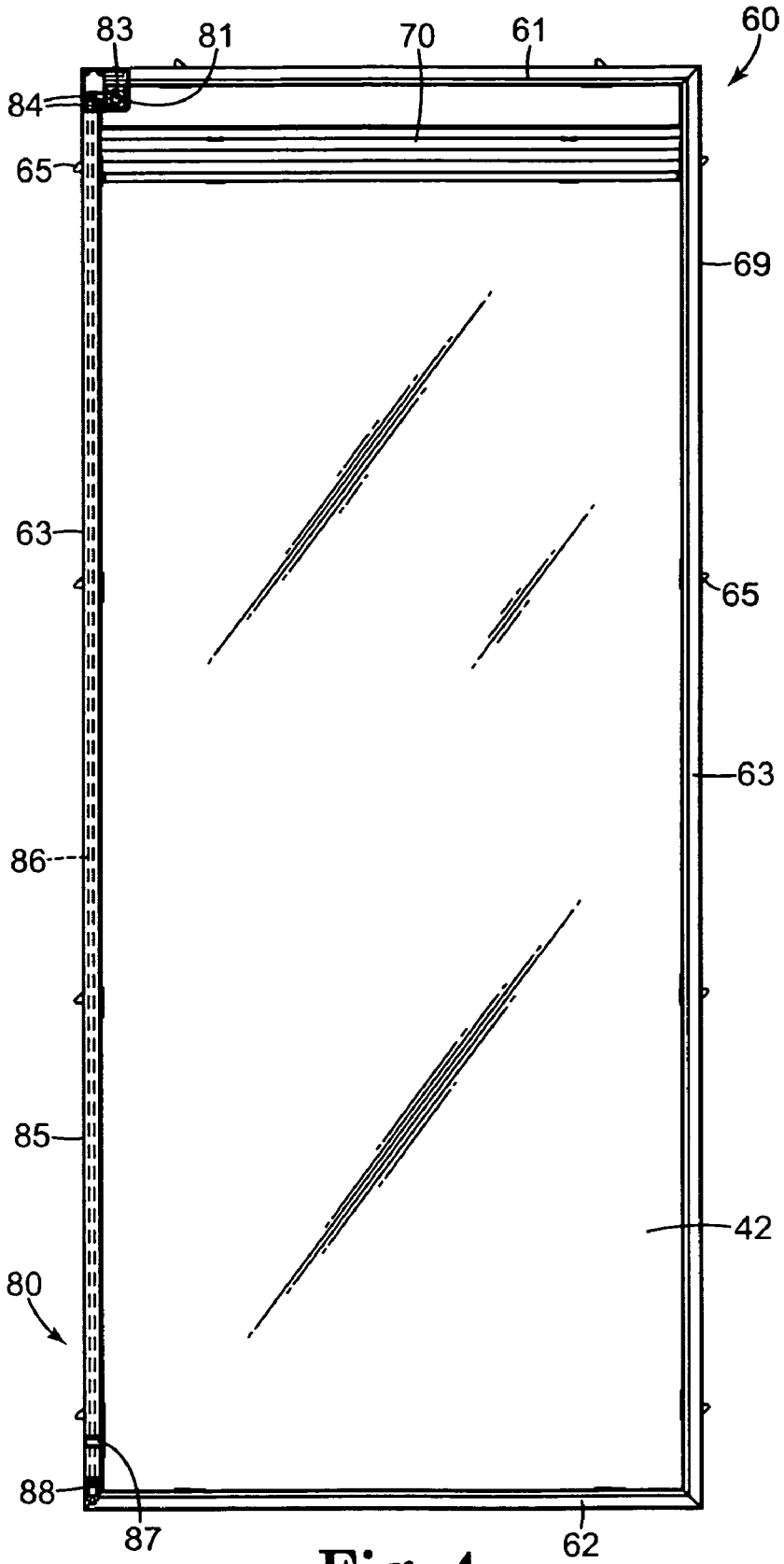
FIG. 4 is a partial, cut-away view of the panel of FIG. 3.

Referring now also to FIGS. 3 and 4, in this embodiment of the fenestration product 40, the sash 50 includes a removable glass panel 60, commonly know in the industry as a double glazing panel or DGP. The glass panel 60 includes the interior glass pane 42 mounted within a panel frame 69 having a panel head 61, panel sill 62 and panel jambs or side walls 63.

Referring now also to FIGS. 3 and 4, the glass panel 60 is shown removed from the window frame 46 and without the optional screen 44, with an interior side 66 of the glass panel 60 facing forward. As used herein, the term "interior" generally refers to the side of the fenestration product inside a dwelling or other building and the term exterior generally refers to the outdoor side of the product. However, when the fenestration product is mounted totally inside a building, such as door or window between two indoor rooms (for example, an office door or window), then interior refers to the side of the product at which a user would normally operate the product or a window covering for the product and exterior refers to the opposite side. Multiple retractable tabs 65 are provided to secure the glass panel 60 within the sash 50.

Along one panel jamb 63, (in this embodiment shown on the left side of the glass panel 60, however the other side may also be used), a sliding operator 80 is provided to control the extension/contraction and/or other adjustment of the window covering 70. The sliding operator 80 may be installed within the panel jamb 63 during formation of the glass panel 60 or, alternatively, the sliding operator 80 may be provided as an add-on accessory and attached to the panel jamb 63. In the latter situation, existing fenestration products 40 already installed in buildings may be retrofit with the present invention for added versatility for a consumer.

The sliding operator 80 includes a handle 87 that slidably moves along a slide channel 85 formed with a panel jamb 63. Although shown in one position that is generally perpendicular to the glass pane 42, the handle 87 may be repositioned generally parallel to the glass pane 42, if desired, or may be placed in any other suitable position or location for manipulation and control of the slide channel 85. The handle 87 is connected to a drive mechanism 86, such that generally linear movement of the handle 87 along the slide channel 85 results in movement of the drive mechanism 86. In one embodiment, the drive mechanism 86 includes a belt, such as a timing belt that may or may not include teeth. The belt 86 is shown mounted perpendicular to the glass pane 42, however other mounting configurations are also possible. Optionally, the drive mechanism 86 may be, but is not limited to, a chain, perforated tape, rope, cord, or other suitable driving component.

Figure 5:
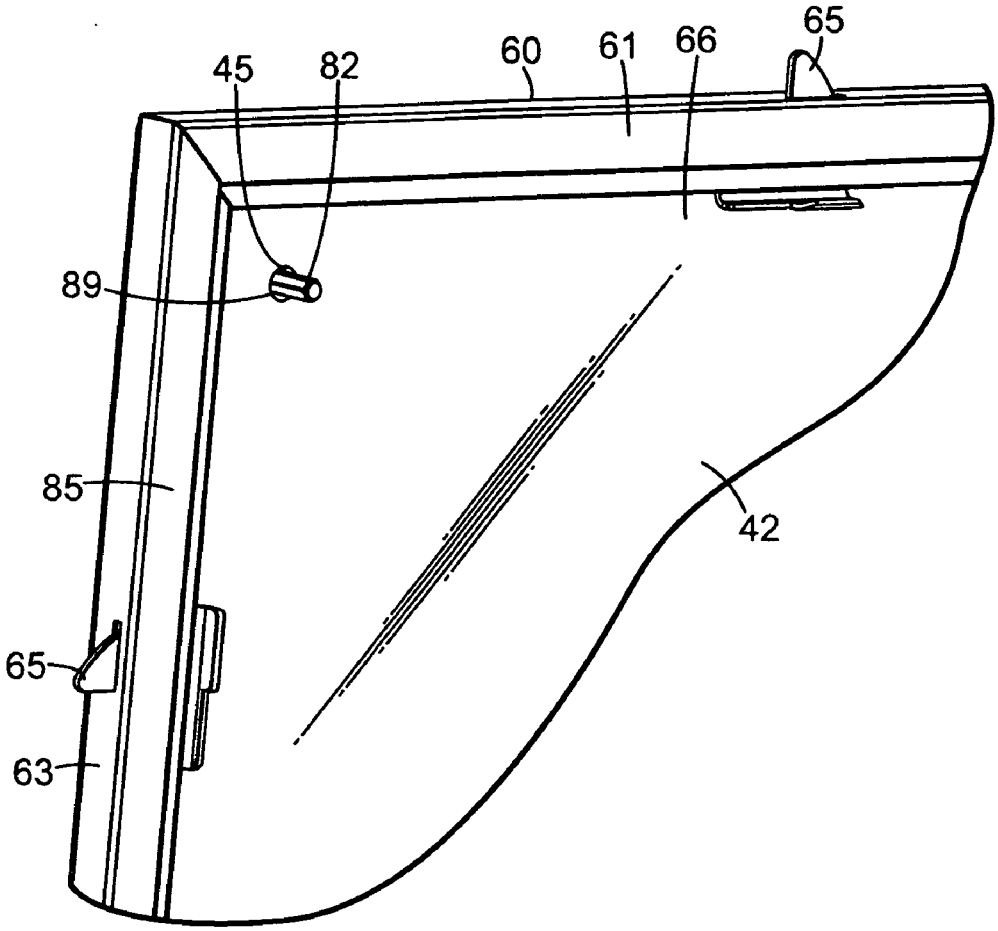
FIG. 5 is a partial detail view of the panel of FIG. 3 showing a through-the-glass shaft.

At an intersection of panel jamb 63 and the panel head 61, a pulley enclosure 81 is mounted. Referring now also to FIG. 5, within the pulley enclosure is a sprocket 83 mounted to a shaft portion 82 that extends through an aperture 45 in the glass pane 42. Driving mechanism 86 is routed around shaft pulley 83 such that the shaft pulley 83 engages the driving mechanism 86. Movement of the driving mechanism 86, by sliding movement of handle 87, thus results in rotation of shaft portion 82. A seal 89 is configured around shaft portion 82 to maintain the integrity of space between the glass panes 52.

Drive mechanism 86 is routed about a pair of pulleys 84, also mounted within pulley enclosure 81, which guide the drive mechanism 86 from the shaft pulley 83 toward the slide channel 85. In this embodiment, guiding of the drive mechanism 86 by the pulleys 84 results in about a 90 degree direction change for the driving mechanism 86. Adjacent to the panel sill 62, a third pulley 88 is positioned so that the drive mechanism 86 routes around it at an opposite end of the glass panel 60. In this embodiment, the drive mechanism 86 is configured as a continuous loop, however other configurations are also possible and within the scope of the present invention.

Figure 6:
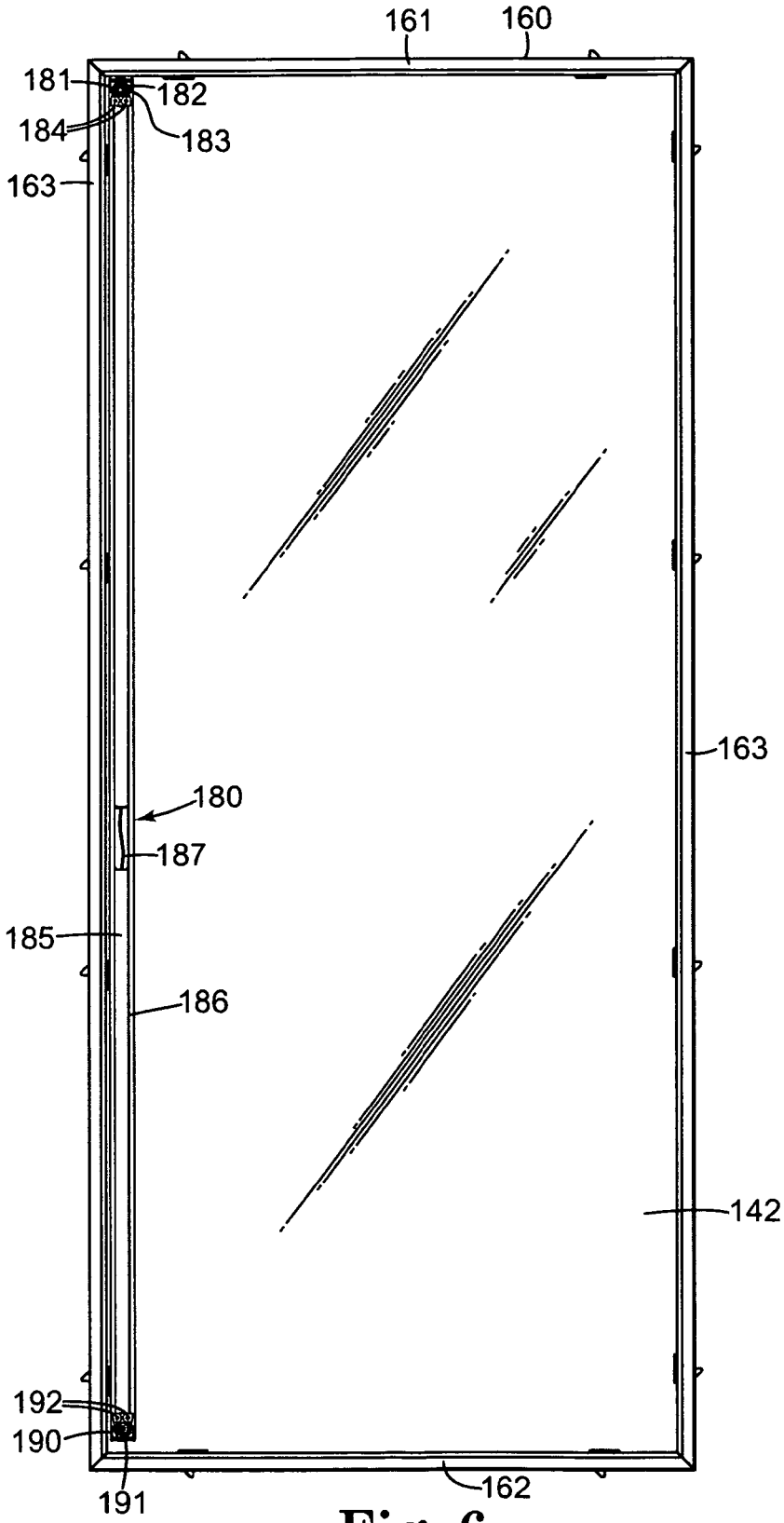
FIG. 6 is front, interior view of window panel, including another embodiment of a sliding operator for a between-the-glass window covering in accordance with the present invention.

Referring to FIG. 6, an alternative embodiment of a sliding operator 180 of the present invention is shown for a removable glass panel 160 including glass pane 142. In this embodiment, the sliding operator 180 is mounted to the glass pane 142, instead of being configured as part of a panel jamb, such as jamb 63 as described above. The sliding operator 180 includes a slide channel 185 in which a driving mechanism 186 is routed. A handle 187 slides along slide channel 185 providing movement of the driving mechanism 186.

Adjacent panel head 161, a pulley enclosure 181 is mounted such that the drive mechanism 186 is routed around a shaft pulley 183 and a pair of pulleys 184. The shaft pulley 183 is mounted on a shaft 182 that passes through the glass pane 142. In this embodiment, with the sliding operator 180 mounted on the glass pane 142, the sliding operator 180 may be substantially aligned with the shaft 182, thereby removing the need for a 90 degree direction change of the driving mechanism 186, as was described above with respect to driving mechanism 86.

Adjacent panel sill 162, a second pulley enclosure 190 is mounted to the glass pane 142. Within this second pulley enclosure 190, a second pair of pulleys 192 and a third pulley 191 are positioned to route the drive mechanism 186 in an aligned manner with respect to the first pulley enclosure 181 and the shaft 182. In one embodiment, the drive mechanism 186 forms a continuous loop by attachment at the handle 187, such that movement of the handle 187 generally parallel to the member 163 results in smooth, direct movement of the drive mechanism 186 and rotation of the shaft 182.

Although the sliding operator 180 will partially obstruct the view through the glass pane 142 to some extent, in contrast to the offset sliding operator 80 located on a panel jamb 63, the on-glass sliding operator 180 has other advantages. In particular, although the sliding operator 180 mounted to the glass pane 142 may be used with any type of fenestration product, it is especially useful with sliding glass doors, double-hung type windows or other sliding-type fenestration products. The on-glass mounting of the sliding operator 180 provides a lower profile for the fenestration product, and thus accommodates the passing of one component of a fenestration product relative to a closely adjacent component of that fenestration product.

Figure 7:
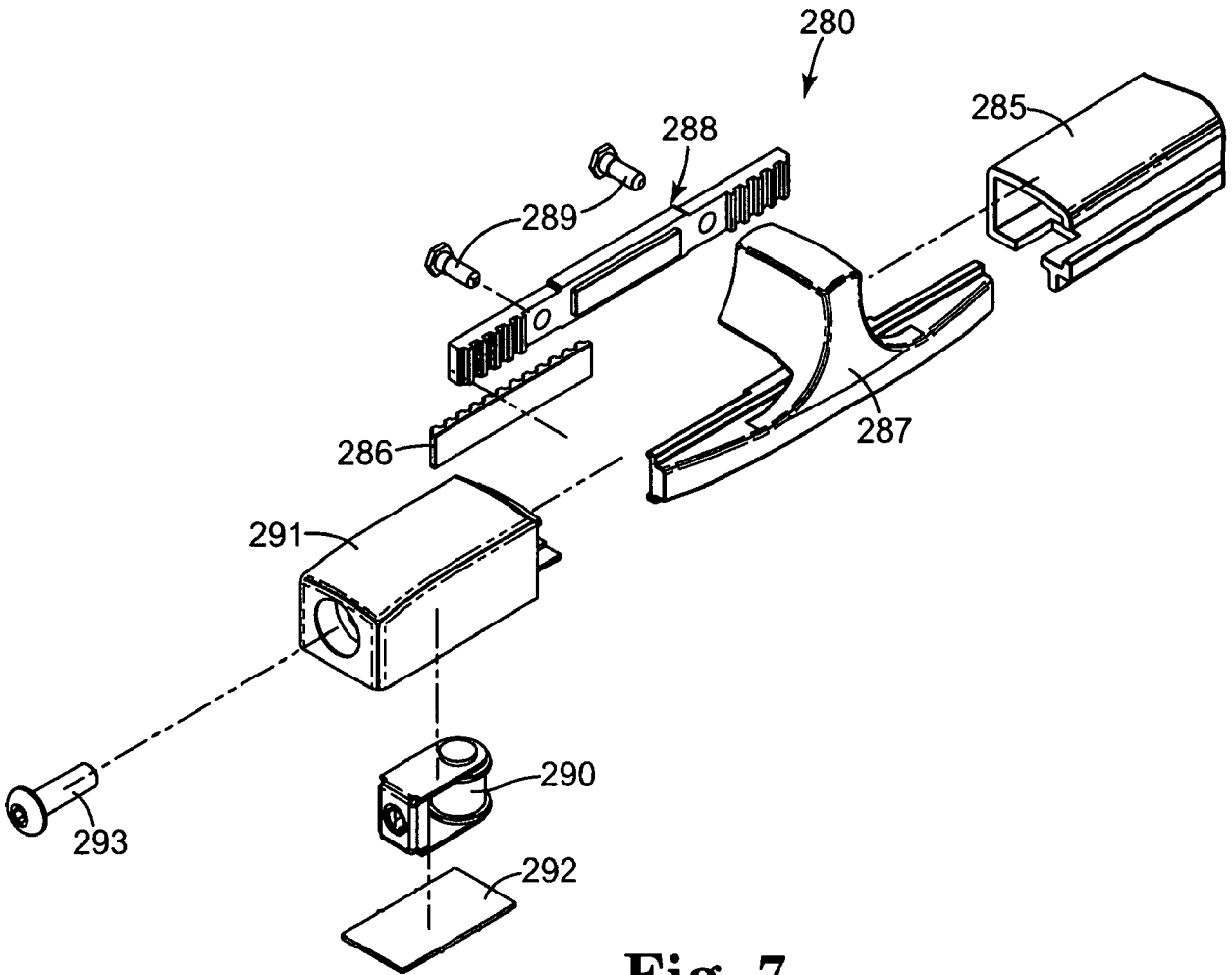
FIG. 7 is an exploded view of one embodiment of the handle portion of a sliding operator in accordance with the present invention.
Figure 8:
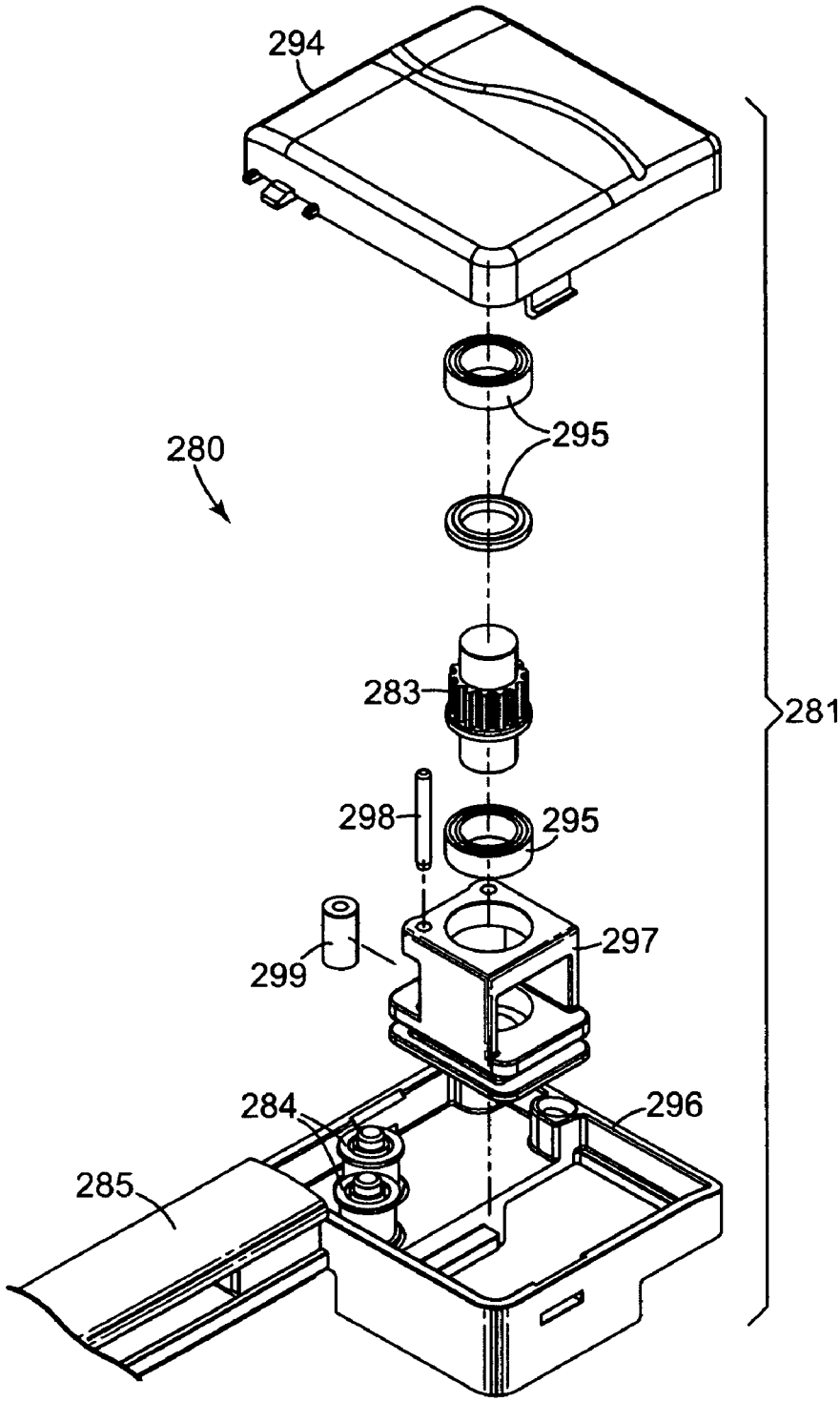
FIG. 8 is an exploded view of one embodiment of the pulley and shaft portion of a sliding operator in accordance with the present invention.

Referring to FIGS. 7 and 8, another alternative embodiment of a sliding operator 280 is shown including a slide channel 285 in which a driving mechanism 286 is routed. In this embodiment, the drive mechanism 286 is a timing belt. A handle 287 slides along slide channel 285 providing movement of the timing belt 286. A bracket 288 that mates with the timing belt 286 clamps the ends of the timing belt 286 at the handle 287 using fasteners 289, thereby forming a continuous loop of timing belt 286 throughout the sliding operator 280. A lower pulley 290 is secured by fastener 293 within a housing 291 that has a back plate 292 and is attached to one end of the slide channel 285. The lower pulley 290 is mountable at or near the panel sill (not shown).

The timing belt 286 is routed around the lower pulley 290 forming the lower end of the timing belt loop. The lower pulley 290 is adjustable within the housing 291 by rotation of fastener 293, such that movement of the lower pulley 290 toward and away from the panel sill (not shown) adjusts the tension within the timing belt 286 for efficient operation of the sliding operator 280.

A pulley enclosure 281 attached to the other end of the slide channel 285 is mountable adjacent a panel head (not shown) at an opposite end from the lower pulley 290. The timing belt 286 is routed around a corresponding timing belt sprocket 283 and a pair of pulleys 284 mounted within a pulley housing 296 that is enclosed by cover 294. The sprocket 283 is mountable to a shaft (not shown), such as previously described shaft portion 82 that passes through the glass pane 42. In this embodiment, the sprocket 283 is mounted on bearings 295 within a shaft housing 297 to facilitate routing and function of the timing belt 286, which is also aided by roller 299 attached by pin 298 to the shaft housing 297.

Figure 9:
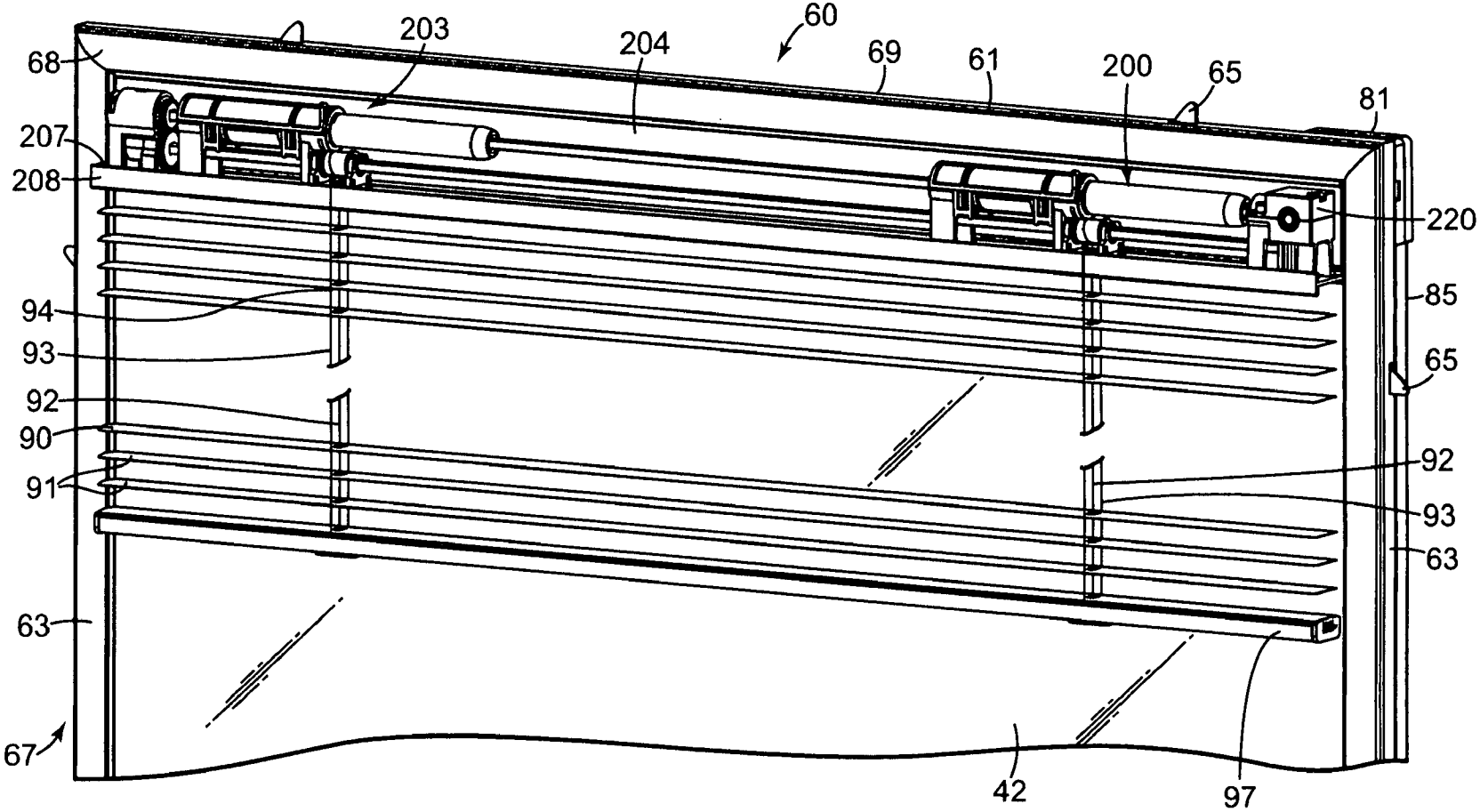
FIG. 9 is an back, exterior view of a window panel including a between-the-glass blind and one embodiment of a window covering actuation system in accordance with the present invention.

Referring now to FIG. 9, an exterior side 67 of glass panel 60 is shown with a horizontal blind 90 attached. A sealing member 68 is provided around the circumference of the glass panel 60 in order to seal the glass panel 60 to the sash 50 when the glass panel 60 is secured to the sash 50 by retractable tabs 65. The blind 90 includes a plurality of slats 91 that extend generally from one panel jamb 63 to the other with enough slats 91 to extend generally from the panel sill 62 (not shown) to an area adjacent the panel head 61 when the blind 90 is about fully extended. For clarity in this figure, only a portion of the plurality of slats 91 are shown. It is to be understood, that different configurations of blinds may also be used in keeping with the present invention.

In this embodiment, the plurality of slats 91 may be contracted by retraction of a plurality of lift cords 92, as will be described in more detail below. The plurality of slats 91 may also be rotated or tilted from a generally horizontal position (as shown) to an angled orientation that is somewhat less than vertical, in either direction, by movement of a plurality of ladder cords 93, which will also be described in more detail below. Extension/contraction and angular adjustment or tilting of the blind slats 91 allows an operator to provide desired light passage through and coverage of the glass pane 42 of the fenestration product 40.

Figure 10:
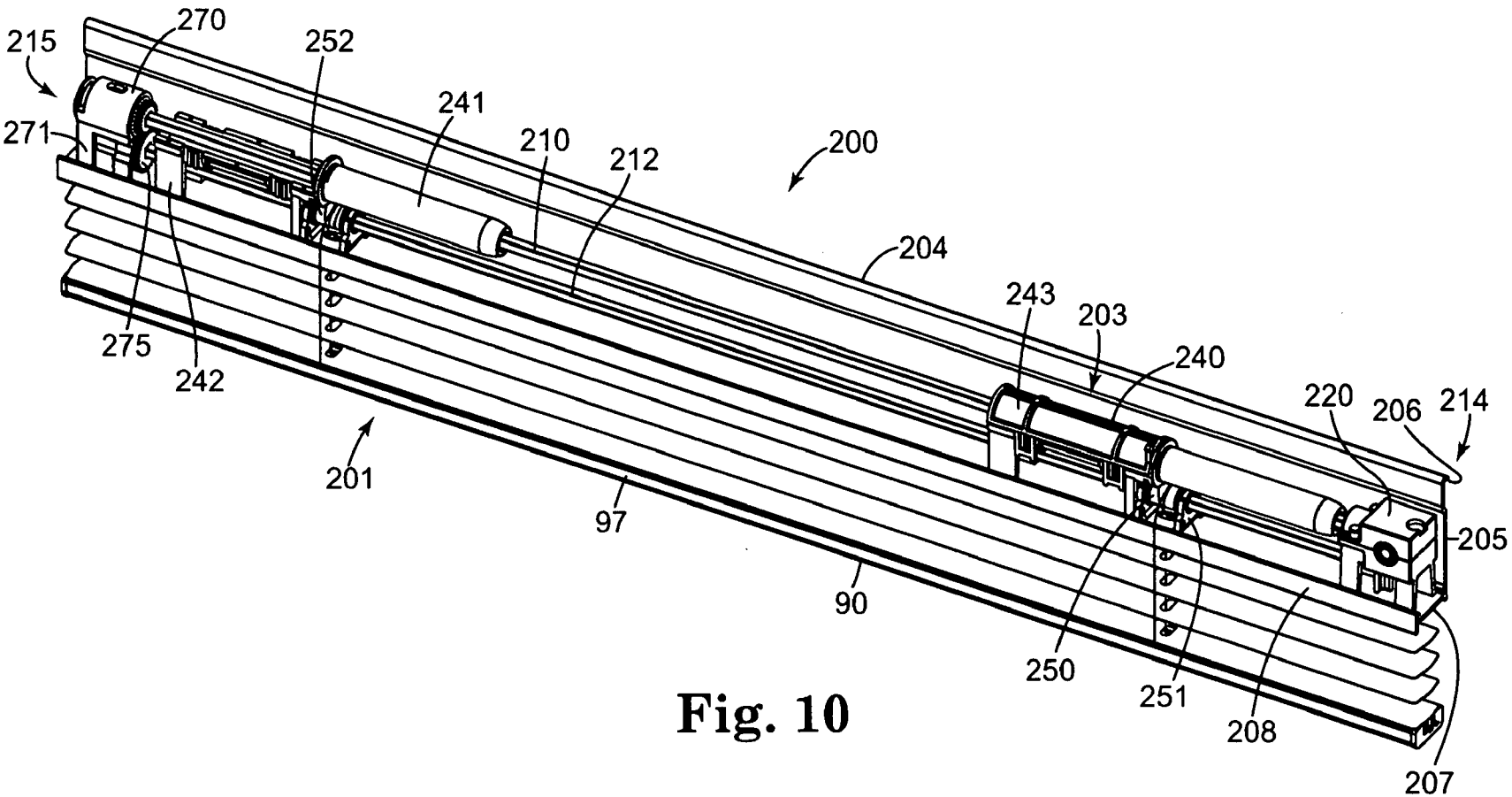
FIG. 10 is a detail, exterior view of a window covering actuation system.
Figure 11:
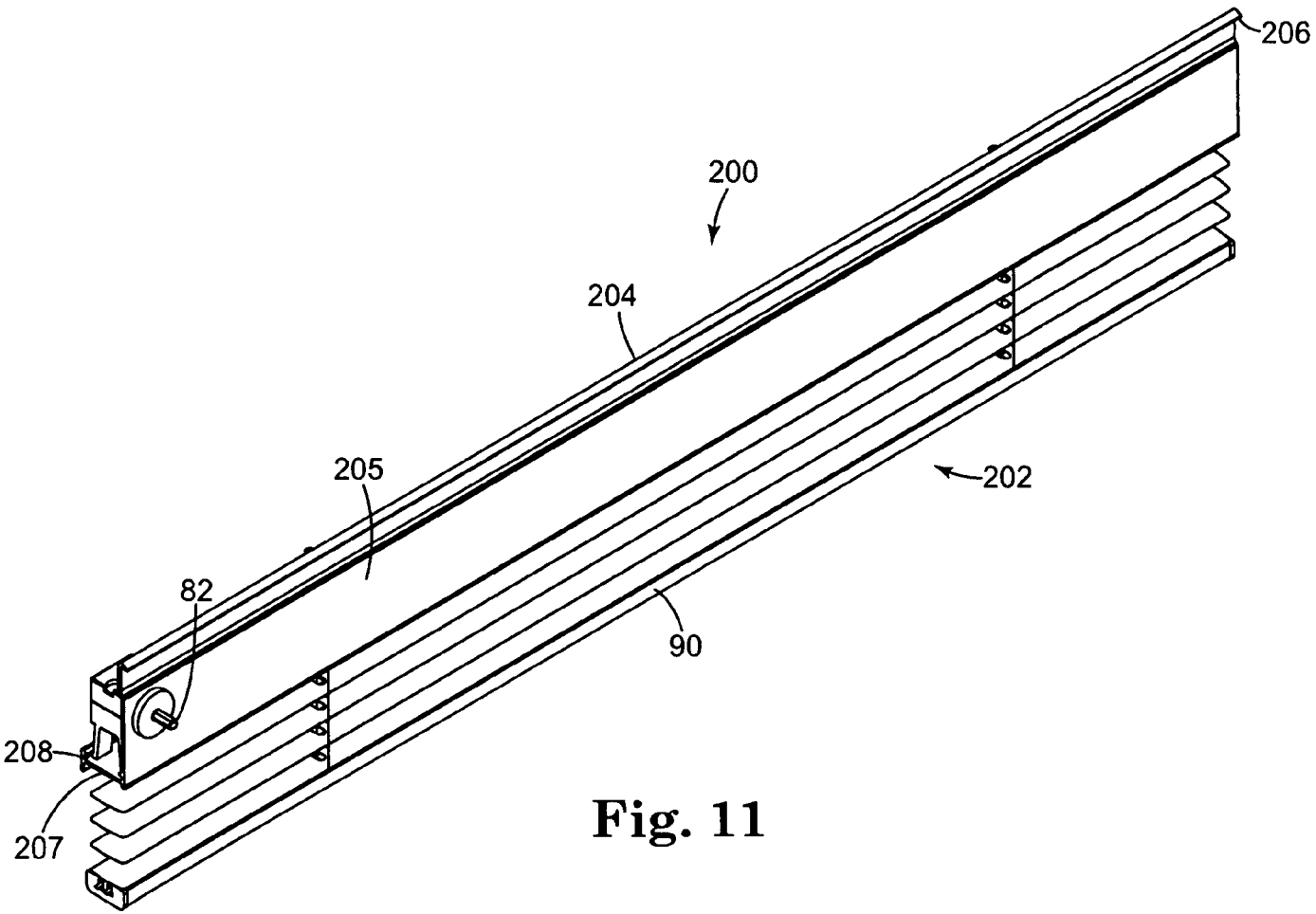
FIG. 11 is a detail, interior view of the window covering actuation system of FIG. 10.

Referring now also to FIGS. 10 and 11, the blind 90 or other window covering is attached to a window covering actuation system 200 mounted to the glass panel 60 at a head channel 204 adjacent the panel head 61. The head channel 200 has a general 'L' shaped cross-section formed by a sidewall 205 and a shelf 207. The sidewall 205 includes an upper hook 206 to aid in mounting the head channel 200 to the panel head 61. The shelf 207 includes a toe portion 208 for retaining components 203 of the actuation system 200 in the head channel 204 and, optionally, for connecting these components 203 to the head channel 204.

As shown in FIG. 11, on an interior side 202 of the head channel 204, the sidewall 205 is a generally flat wall providing a uniform and plain appearance to the interior of a dwelling or other building for an indoor viewer. Thus, an operator of the blind 90 or a viewer of or through the fenestration product 40 does not see the components 203 of the actuation system 200, thereby providing a more pleasing appearance to the fenestration product 40. As shown in FIG. 10, however, on an exterior side 201 of the head channel 204, the components 203 may be exposed or may optionally be covered by another wall (not shown) coupled to the toe 208, the shelf 207 or one or more of the components 203.

In this embodiment, the components 203 of the actuation system 200 include two driving shafts, a rotating lift shaft 210 and a rotating tilt shaft 212. For embodiments using a only a non-tilting window covering, such as a shade, the tilt shaft 212 may be eliminated or provided, but not utilized. The components 203 also include a gear box 220 mounted to the head channel 204 and coupled to at least the lift shafts 210 at a first end 214. The actuation system 200 connects to shaft 82 at gear box 220, the shaft 82 passing through the glass pane 42. The shaft 82, in turn, is coupled to and driven by sliding operator 80, such that linear motion of sliding operator 80 results in rotational motion of shaft 82 and corresponding operation of the actuation system 200 by rotational motion of lift shaft 210.

Figure 12:
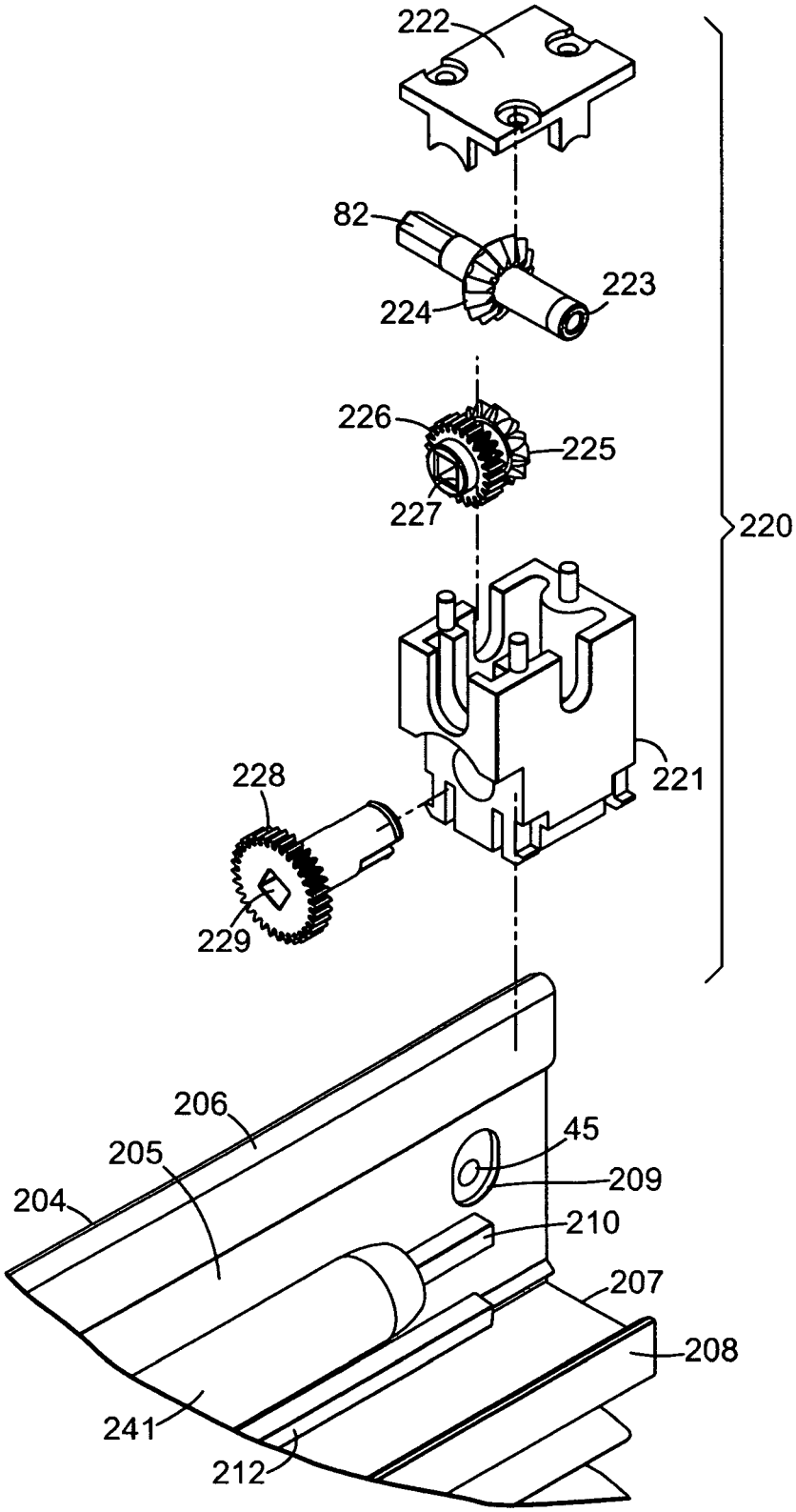
FIG. 12 is an exploded view of one embodiment of a gear box usable with a window covering actuation system in accordance with the present invention.

Referring now to FIG. 12, one embodiment of the gear box 220 is shown in an exploded view. The gear box 220 includes a housing 221 with a cover 222. A shaft 223 incorporates shaft portion 82 that protrudes through the glass pane 42, as described above. Shaft 223 also includes a first bevel gear 224 mounted to or formed with the shaft 223. A second bevel gear 225 is mounted with the housing 221 to mate with the first bevel gear 224. A first spur gear 226 is coupled to, or formed with, the second bevel gear 225, with the combined gears 225, 226 mounted within the housing 221 so as to provide an external interface 227 for lift shaft 210. A second spur gear 228 is also mounted within the housing 221 in a mating relationship with the first spur gear 227 and so as to provide an external interface 229 for tilt shaft 212. In operation, when protruding shaft portion 82 is rotated, rotation of shaft 223 and the first bevel gear 224 results in rotation of lift shaft 210. This rotation produces a corresponding rotation in the tilt shaft 212 through the spur gear set 226, 227.

The combination of the bevel gears 224, 225 and sliding operator 80 preferably includes an amount of gear reduction, such that a full range of motion of the window covering 90 is achieved by relatively less motion of the sliding operator 80. In one embodiment, this ratio of handle travel to covering travel is about 70 percent. The gear ratio of the gears 224, 225 contributes in part to this travel ratio. However, also contributing to this travel ratio is the relationship of the sliding operator 80 structure to the covering actuation structure, as described below.

Figure 13:
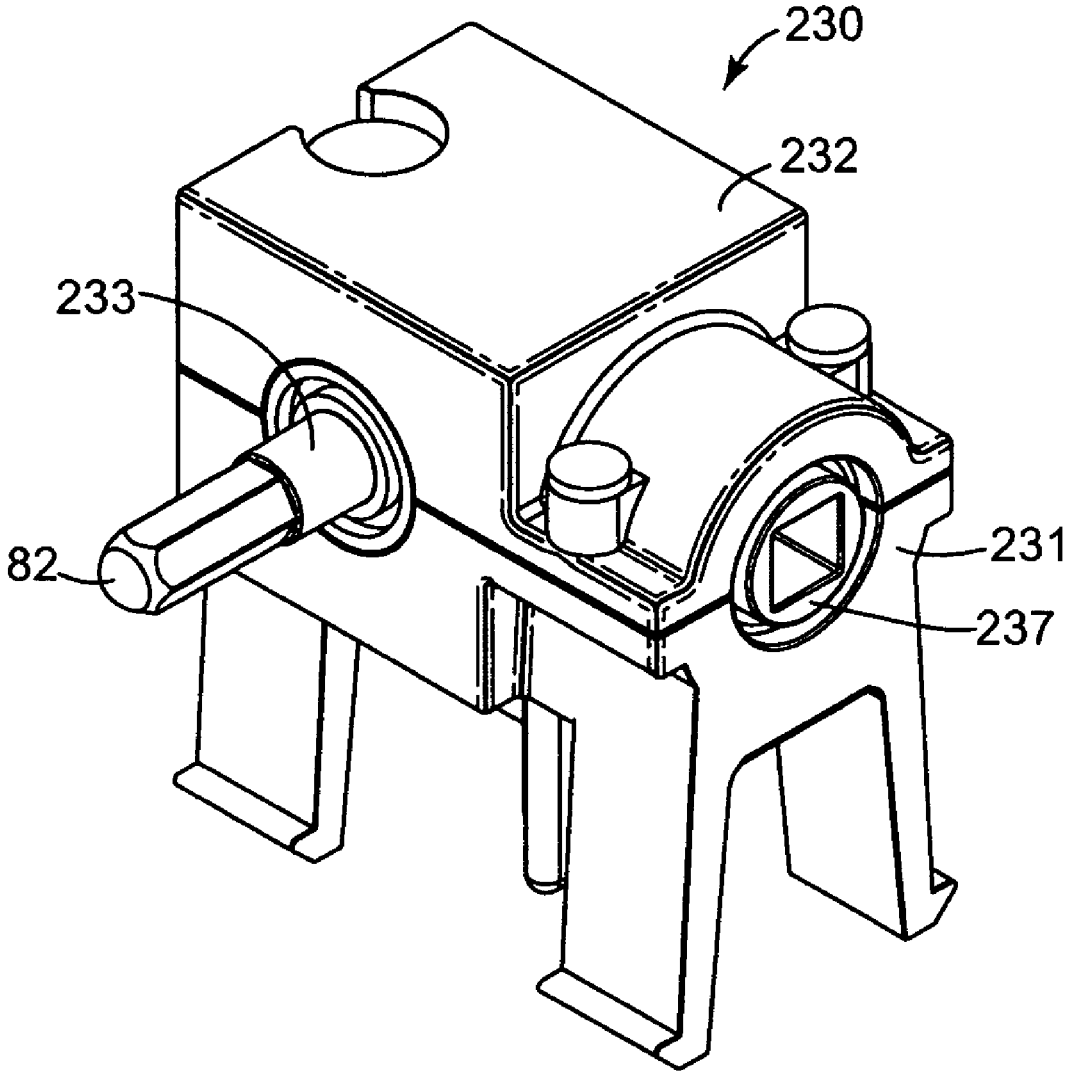
FIG. 13 is a perspective view of another embodiment of a gear box usable with a window covering actuation system in accordance with the present invention.
Figure 14:
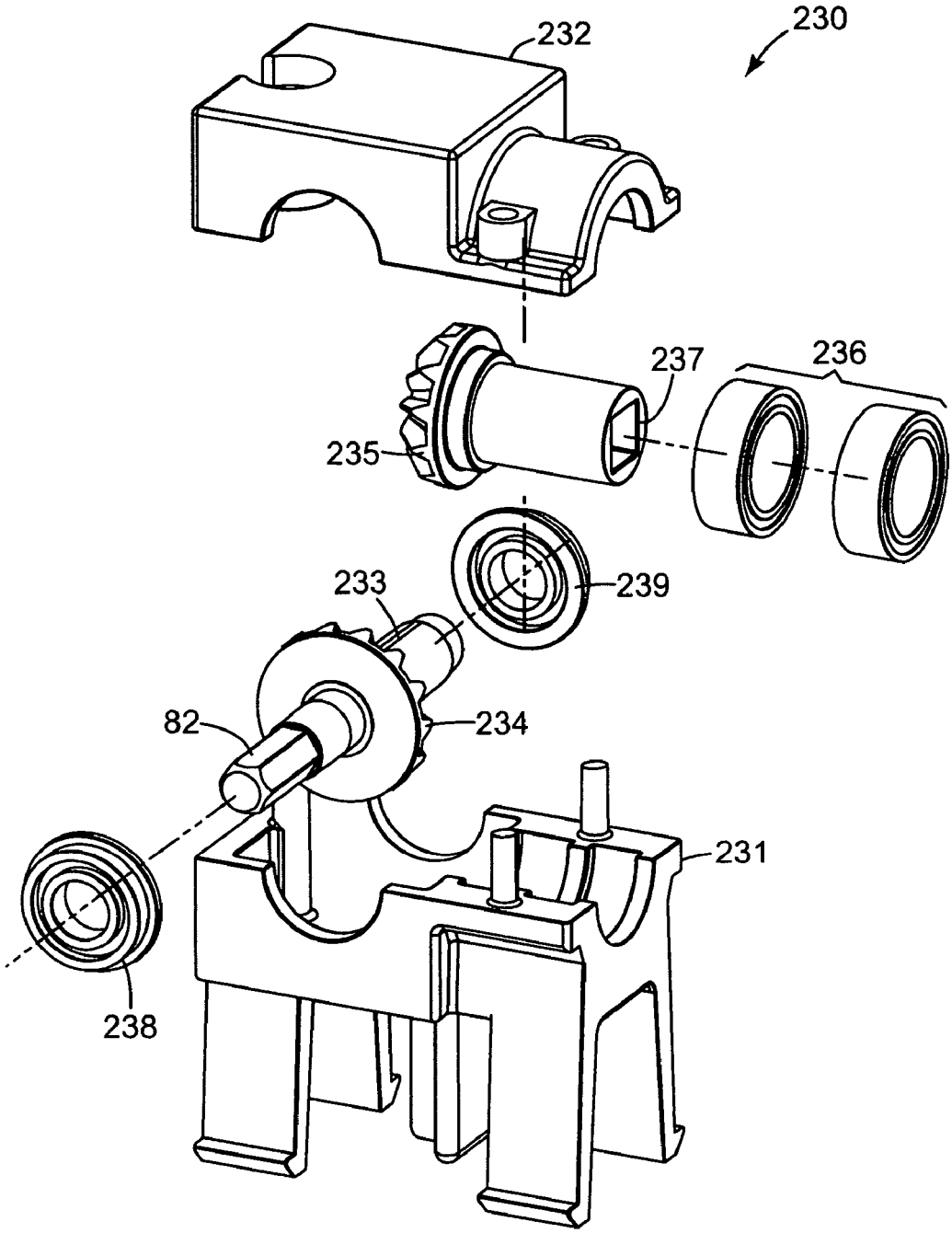
FIG. 14 is an exploded view of the gear box of FIG. 13.

Referring to FIGS. 13 and 14, an alternative embodiment of a gear box 230 is shown including a housing 231 and a cover 232. A shaft 233 incorporates shaft portion 82 and a first bevel gear 234. A second bevel gear 235 is mounted to mate with the first bevel gear 234 and provide an external interface 237 for the lift shaft 210. One or more bearings 236 supports the external interface 237 within the housing 231. A first ball bearing 238 and a second ball bearing 239 are also provided to support shaft 233 within the housing 231. In this embodiment, spur gears or other coupling mechanisms are not provided as part of the gear box 230 to couple the rotation of the lift shaft 210 to the rotation of the tilt shaft 212. Instead, this coupling is provided as another component 203 of the actuation mechanism 200, as described below.

Referring again to FIG. 10, the actuation system 200 also includes a plurality of lift spool assemblies 240, preferably in a number equal to the number of lift cords 92 of blind 90. Each lift spool assembly 240 includes a lift spool 241 mounted on a support cradle 242 mounted to and supported by the head channel 204. The lift shaft 210 passes through each lift spool 241 with the lift spool 241 coupled to the lift shaft 210 so that rotation of the lift shaft 210 results in corresponding rotation of the lift spool 241.

A protective shroud 243 is preferably positioned over the lift spool 241 to protect the spool 241 and lift cord 92 during operation, such as from dirt/dust contamination. In addition, the shroud 243 keeps the lift cord 92 on the spool 241 in the desired location, thereby minimizing unwanted unwinding and tangling of the lift cord 92. As the spool 241 rotates, it shifts back and forth along the lift shaft 210 with respect to the location of the lift cord 92. As a result, the lift spool 241 retracts into and emerges out of the shroud 243 as the lift cord 92 winds up or unwinds. The protective shroud 243 is optionally positioned over only a portion of the lift spool 241. For example, the protective shroud 243 can be a discontinuous configuration, such as a plurality of elongated members or a perforated structure.

The actuation system 200 further includes a plurality of tilt drum assemblies 250, preferably in a number equal to the number of ladder cords 93. Each tilt drum assembly 250 includes a tilt drum 252 supported by a tilt drum support cradle 251 mounted to the head channel 204. The tilt shaft 212 passes through each tilt drum 252 with the tilt drum 252 coupled to the tilt shaft 212 such that rotation of the tilt shaft 212 results in corresponding rotation of the tilt drum 252. Each tilt drum assembly 250 is positioned adjacent to a lift spool assembly 240 to facilitate routing of the adjacent lift cords 92 and ladder cords 93 from the blind 90, as will be described in more detail below.

Figure 15:
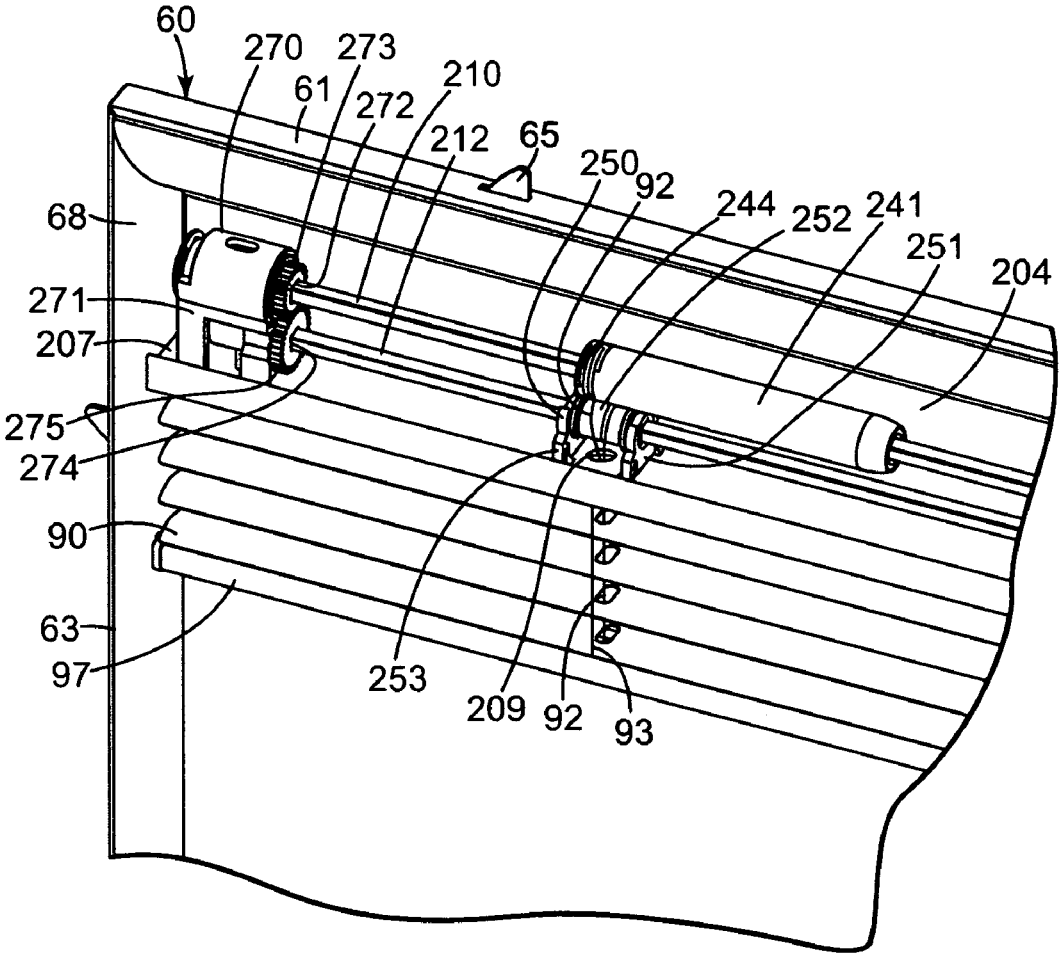
FIG. 15 is a partial detail, exterior view of a window covering actuation system, including a lift spool, tilt drum and clutch/brake assembly.

Referring now to FIG. 15, one embodiment of a lift spool 241 is mounted adjacent tilt drum assembly 250 that includes tilt drum support cradle 251. The lift spool 241 has a spiral groove or thread 244 (of which only a portion is shown for clarity) about which the lift cord 92 winds and unwinds upon rotation of the lift shaft 210 during operation of the actuation system 200. The cradle 251 includes a pair of support legs 253 positioned at either end of the tilt drum 252. The lift cord 92 passes from the lift spool 241 adjacent the tilt drum 252 and through an aperture 209 formed within the shelf 207 of head channel 204, along with the ladder cords 93.

In order to accommodate the routing requirements of the lift cord 92, including its passage through aperture 209, the lift cord 92 is preferably formed from monofilament material, including but not limited to fluorocarbon, nylon, and polyester. The monofilament produces less friction than conventional cordage materials used for window coverings, thus resulting in less binding and snagging of the lift cord 92 during operation of the window covering 90. In addition, use of monofilament material results in less wear and thus longer life for the lift cords 92, thereby increasing the overall life of the window covering 90 itself.

As the lift shaft 210 rotates, the lift spool 241 also rotates causing the lift cord 92 to wind up or unwind about the spool 241, depending on the direction of rotation. With the lift cord 92 attached to a lower most slat or bottom rail 97 of the blind 90, movement of the lift cord 92 results in retraction or extension, respectively, of the blind 90. In order to control the rotation of the lift shaft 210 in both directions, a clutch/brake mechanism 270 is coupled to the lift shaft 210 at a second end 215. In this embodiment, the clutch/brake mechanism 270 is supported by a mechanism support 271 mounted to the head channel 204 at shelf 207. In one embodiment, the clutch/brake mechanism 270 is a spring clutch, however, other types or configurations of clutch and brake mechanisms may also be used.

Figure 16:
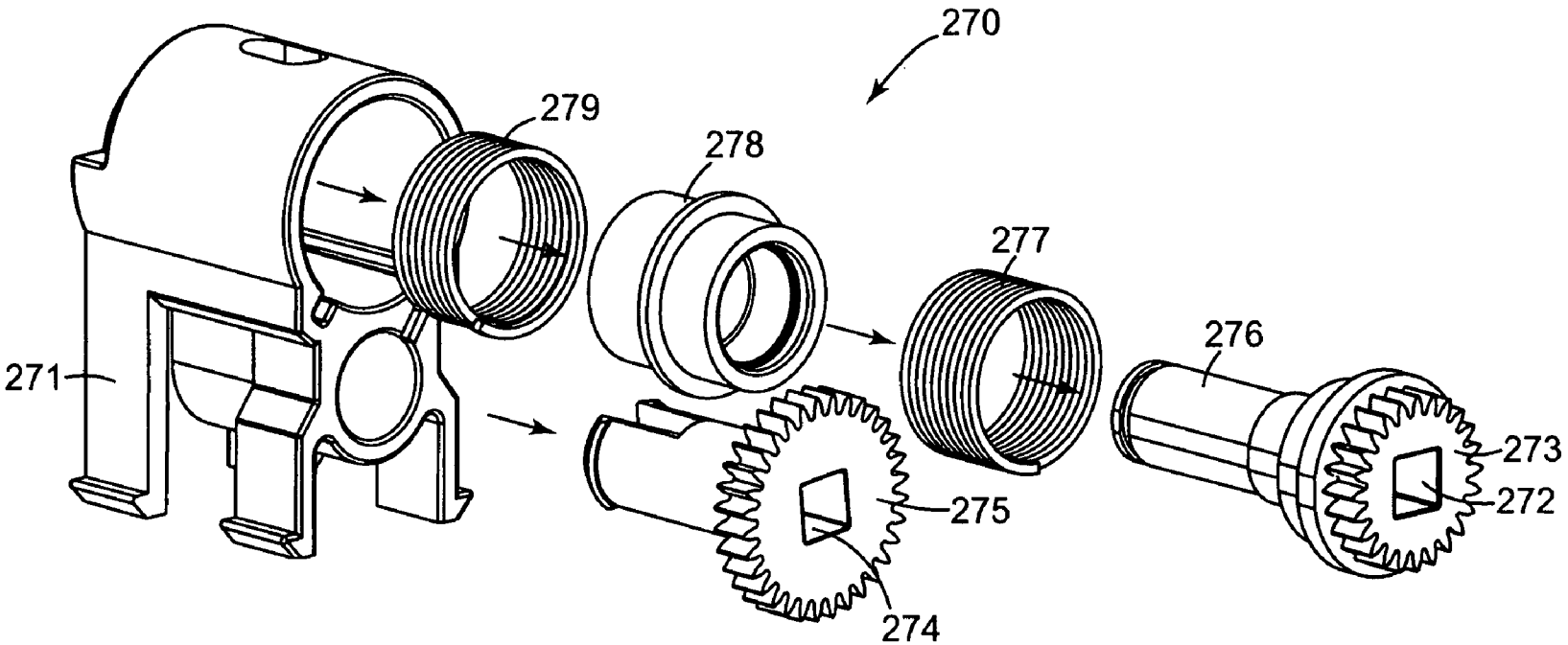
FIG. 16 is an exploded view of the clutch/brake assembly of FIG. 16.

Referring now also to FIG. 16, clutch/brake mechanism 270 includes not only a first shaft mounting 272 for lift shaft 210, but also a second shaft mounting 274 for tilt shaft 212. First shaft mounting 272 is provided within first spur gear 273, which is in turn adjacent to and engaged with a second spur gear 275 that includes second shaft mounting 274. As lift shaft 210 rotates and is controlled by clutch/brake mechanism 270, rotation of the first spur gear 272 causes a corresponding rotation in second spur gear 275, resulting in rotation of the tilt shaft 212.

Clutch/brake mechanism 270 also includes the support housing 271 that is mountable to the head channel 204. Configured to mount within the support housing 271 are a clutch drum 276, coupled to a brake drum 278. The brake drum 278 also couples with a brake spring 279 that is, in turn, keyed to the support housing 271. The clutch drum 276 also couples to a clutch spring 277 that is in frictional contact with the brake drum 278 and the clutch drum 276. When the window covering 90 is being lowered or trying to lower itself under its own weight, the clutch spring 277 cinches down on the brake drum 278, resulting in the rotation of the brake drum 278 and subsequent cinching of the brake spring 279. The brake spring 279 applies enough resistance to prevent the window covering 90 from dropping under its own weight, but does not inhibit deliberate lowering of the window covering 90 by a user using the slide operator 80. When the window covering 90 is being raised or operated in the other direction, the clutch spring 277 spreads open, disengaging the brake drum 278 from the clutch drum 276. Alternatively, the engagement between the lift shaft 210 and tilt shaft 212 may occur at the gear box, as will be described in more detail below with respect to FIGS. 17 and 18.

Figure 17:
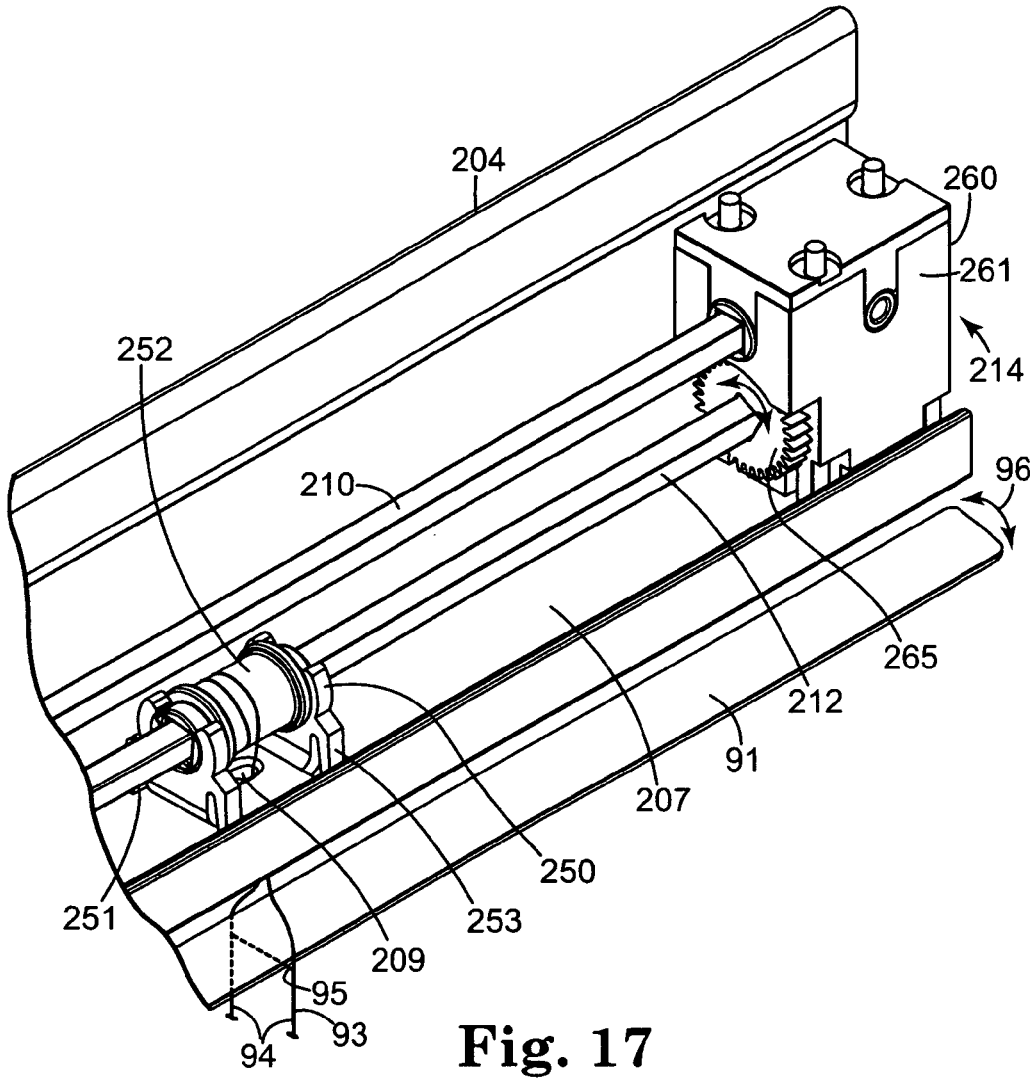
FIG. 17 is a partial detail, exterior view of a window covering actuation system, including a tilt drum and gear box.

As described above, each tilt drum assembly 250 is preferably positioned adjacent a lift spool assembly 240 to facilitate routing of the lift and ladder cords 92, 93, as stated above. Referring now also to FIG. 17, one of the tilt drum assemblies 250 is shown with ladder cord 93 attached, but with the adjacent lift spool assembly 240 not shown for clarity. The ladder cord 93 includes two side cords 94 and a plurality of cross cords 95 spanning between the side cords 94 and positioned under each blind slat 91. The side cords 94 extend upward through aperture 209 formed within the shelf 207 of head channel 204. In one embodiment, these two cords 94 are wrapped around the tilt drum 252 from opposite sides, but are not secured to the drum 252. Alternatively, the cords 94 may be secured to tilt drum 252, if desired. The ladder cords 93 are preferably formed from conventional materials, including but not limited to braided polyester.

When the tilt drum 252 is rotated by rotation of the tilt shaft 212, one side cord 94 will lift upward and the other cord 94 will move downward. As a result, the cross cord 95 will tilt, causing the slat 91 supported by the cross cord 95 to tilt, as well. Depending on the direction of rotation of the shaft 212 and drum 252, the slat 91 will tilt in either direction.

As was described above, in the present invention, rotation of the tilt shaft 212 results from rotation of the lift shaft 210 due to coupling of the shafts 210, 212 together, such as by gears located at the clutch/brake mechanism or at the gear box. In the embodiment shown in FIG. 17, this coupling of the lift and tilt shafts 210, 212 occurs at a gear box 260 that includes a first gear (not shown) mounted to lift shaft 210 within a housing 261 and a second gear 265 mounted to tilt shaft 212 and coupled to the first gear. The lift shaft 210 may rotate around many times during the raising and/or lowering of the blind slats 91. However, only partial rotation of the tilt shaft 212 and tilt drum 252 are necessary to produce the desired amount of tilt for the blind slats 91. In order to accommodate the different rotational requirements of the lift and tilt systems, the side cords 94 are wrapped about the tilt drum 252 in such a way that there is enough friction between the drum 252 and cords 94 to tilt the slats 91 as the drum 252 rotates. However, there is not enough friction to prevent the drum 252 from continuing to rotate after the slats 91 have tilted to their limit, in one direction or the other. Reversing rotation of the lift shaft 210 will repeat the process in the opposite direction.

Figure 18:
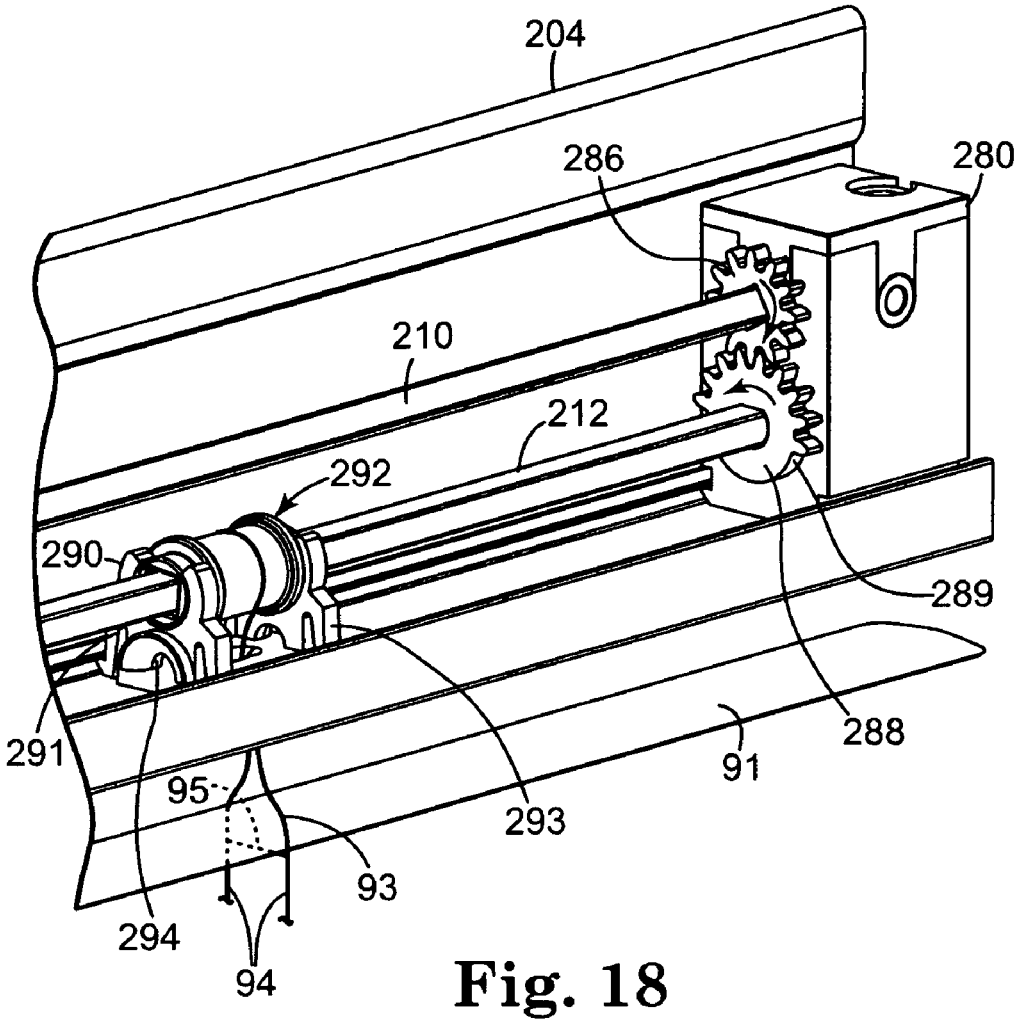
FIG. 18 is a partial detail, exterior view of an alternative window covering actuation system, including another embodiment of a tilt drum and another embodiment of a gear box.

Referring to FIG. 18, an alternative embodiment is shown in which the ladder cord 93 is attached to a tilt drum 292 at side cords 94. In order to accommodate full rotation of the lift shaft 210, an alternative gear box 280 is provided including a first spur gear 286 coupled to the lift shaft 210 and a second spur gear 288 coupled to the tilt shaft 212. In this embodiment, the second spur gear 288 includes a circumferential toothless area 289 without gear teeth. The second spur gear 288 is positioned relative to the first spur gear 286, such that the second spur gear 288 reaches the toothless area 298 at a tilt limit of the slats 91, thus allowing the first spur gear 286 and lift shaft 210 to continue rotating without rotating the tilt shaft 212 or drum 252. In a like manner, a reversal of direction by the lift shaft 210 results in tilt movement of the slat 91 in the opposite direction until the other tilt limit is reached. As would be apparent to one of skill in the art, other mechanisms for coupling the tilt drum 252 and tilt shaft 212 to the lift shaft 210 to achieve the desired range of motion are also possible and are within the spirit and scope of the present invention.

The present invention provides a fenestration product having a window covering that is operated and adjusted by a sliding operator on the interior side of the product. No interior cords are provided or required to operate or adjust the window covering. The window covering of the present invention is particularly well suited for between-the-glass applications, but can also be used on the interior of a fenestration product. The present invention thus simplifies the window covering's operation and eliminates unsightly and potentially hazardous cords. By operation of the single sliding operator, both expansion/contraction and tilt adjustment of the window covering may be achieved.

With many types of window coverings usable with a fenestration product, lift or contraction of the covering is achieved by using lift cords, such as lift cords 92 described above. In the situation where control cords are provided, the control cords are commonly usable to adjust both the position and level of the bottom rail, such as bottom rail 97 shown in FIG. 9. If one lift cord is shortened or lengthened differently than one or more other lift cords, the level of the bottom rail will be affected and it will not be generally horizontal. Level adjustment of the bottom rail usually then requires adjustment of the lift cords by the control cords. However, for window coverings without external cord control, such as those used in conjunction with the present invention, leveling of the bottom rail may be difficult to manage.

Figure 19:
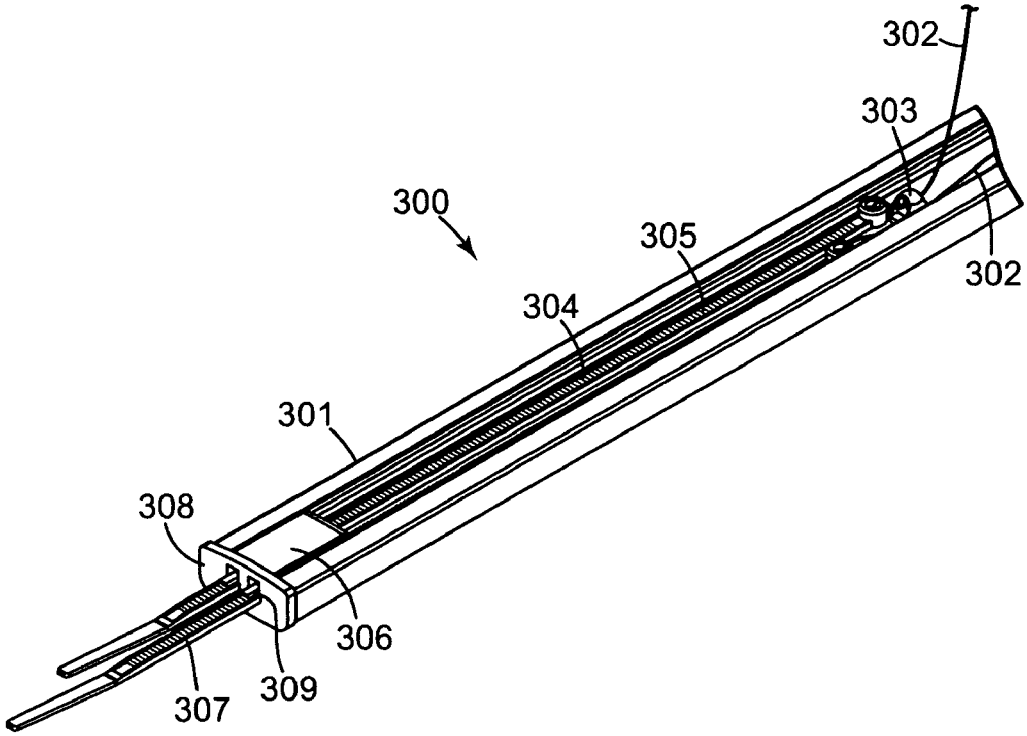
FIG. 19 is a partial detail view of one embodiment of a bottom rail of a blind usable as a between-the-glass window covering, including a lift cord adjustment system.
Figure 20:
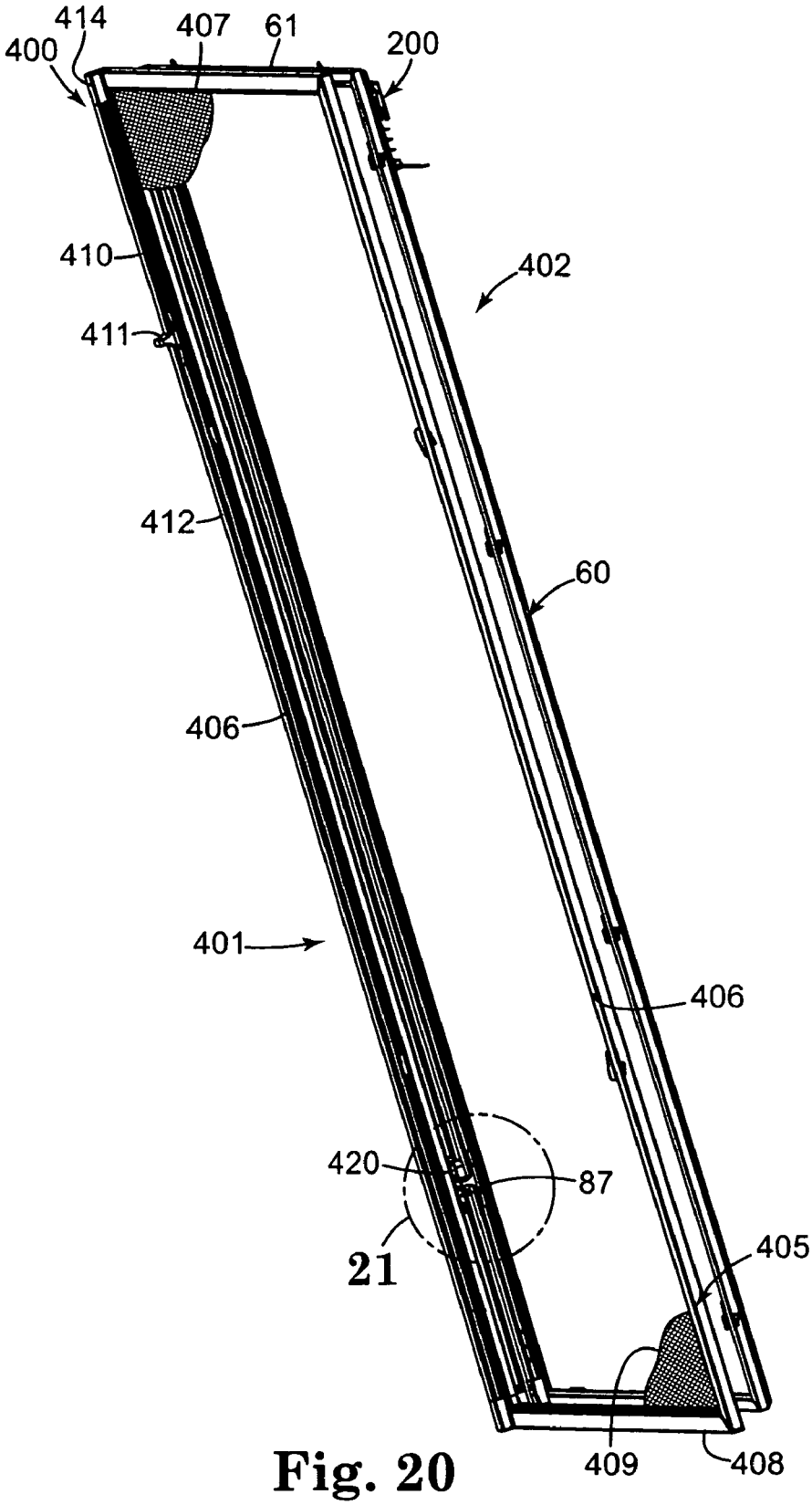
FIG. 20 is a perspective view of a window panel and interior insect screen attachable to the window panel in accordance with the present invention, including a sliding screen operator that engages the sliding operator on the panel.

Referring now to FIG. 19, one embodiment of a bottom rail 300 is shown, including a bottom rail channel 301. For standard window coverings (not shown), the lift cords are knotted or otherwise secured within the bottom rail channel 301 requiring adjustments to the cords to be made at drive system at the top of the window covering. In this embodiment, each lift cord 302 enters the bottom rail channel 301 and passes through a T-plug 303 that routes the lift cord 302 in about a 90 degree direction change, generally from vertical to horizontal. In addition, the T-plug 303 may be used to secure a corresponding ladder cord (not shown) to the bottom rail 300. In one embodiment, the bottom rail channel 301 is covered by a lowest slat (not shown) of the window covering From the T-plug 303, the lift cord 302 is routed to and attached to a cord adjuster 304. For window coverings having multiple lift cords 302, multiple cord adjusters 304 may be provided. For window coverings with two cords 304, two cord adjusters 304 are provided, preferably with one at each end of the bottom rail 300. For wider window coverings normally having four lift cords 304, four cord adjusters 304 are provided, preferably with two at each end, as shown. The cord adjuster 304 is configured to move in at least one direction, so as to pull on the attached lift cord 302. Optionally, the cord adjuster 304 may be configured to move in two directions, so as to provide more versatility in adjustment and/or readjustment of the lift cord 304 and, thus, the level of the bottom rail 300. Cord adjuster 304 may be formed as a strip, rod or other suitable item for attachment to the lift cord 302 and adjustable movement within the bottom rail channel 301. In one embodiment, as shown in FIG. 20, the cord adjuster 304 is a strip having notches or teeth 305, such as a zip tie.

Cord adjuster 304 is mounted within bottom rail channel 301 adjacent to and engaged with a locking mechanism 306. Locking mechanism 306 is configured to allow the cord adjuster 304 to move in one direction and to prevent movement in the other direction. Alternatively, the locking mechanism 306 may be configured for releasable engagement of the cord adjuster 304, so that movement of the cord adjuster 304 may occur in more than one direction upon release of the locking mechanism 306. In one embodiment, the locking mechanism 306 is a locking tab (not shown), either fixed or releasable, that engages the notches or teeth 305 of the cord adjuster 304. This locking mechanism 306 may be formed from plastic, nylon, metal or other light, but suitable materials. Alternatively, the locking mechanism 306 may be configured for use with a cord adjuster 304 without notches or teeth 305, and may be either fixed or releasable. This mechanism 306 may be formed from plastic, metal or other suitable materials.

In the embodiment shown in FIG. 19, the locking mechanism 306 is provided as part of an end cap 308 for the bottom rail 300. The end cap 308 may be configured so that the cord adjusters 304 pass through one or more apertures 309 in the end cap 308. Protruding portions 307 of the cord adjusters 304 may then be trimmed flush with the end cap 308 once adjustment to the lift cords 302 has been made, if desired in some embodiments. However, configurations with the cord adjusters 304 completely internal to the bottom rail channel 301 and/or separate from the end cap 308 are also possible.

In operation, once the window covering is mounted in place, the lift cords 302 may be adjusted by movement of the cord adjusters 304, so as the shorten or lengthen the lift cords 302. Adjustment of the lift cords 302 results in leveling adjustment of the bottom rail 300, as desired.

As shown in FIG. 1, many fenestration products 40 include an optional interior insect screen 44 that may be removably positioned over the glass panel 60 from inside a room or building. For fenestration products 40 that include a sliding operator 80 of the present invention for manipulation and control of a between-the-glass window covering 70, standard installation of the interior insect screen 44 would block a user's access to the sliding operator 80 and thus inhibit the user's control and operation of the window covering 70.

Referring now to FIGS. 20–24, a screen assembly 400 is shown mounted on an interior side of glass panel 60. The screen assembly 400 includes frame 405 having side members 406, head member 407 and sill member 408. Mounted within the frame 405 is an insect screen 409. One of the side members 406 includes a screen operator 410, including handle 411 mounted on an interior side 401 of the screen assembly 400 for slideable movement within channel 412. A coupler 420 is also mounted for slideable movement along coupler channel 425 on the same member 406, but on an exterior side of 402 of screen assembly 400. Movement of the coupler 420 is tied to movement of the handle 411, such that as handle 411 is slid along channel 412, a drive assembly 414 produces corresponding sliding movement of the coupler 420 along coupler channel 425. In this embodiment, the handle 411 and coupler 420 are offset from one another and driven in opposite directions from one another. As the handle 411 is slid through a full range of motion on screen assembly 400, the coupler 420 also moves through a full range of motion.

Figure 21:
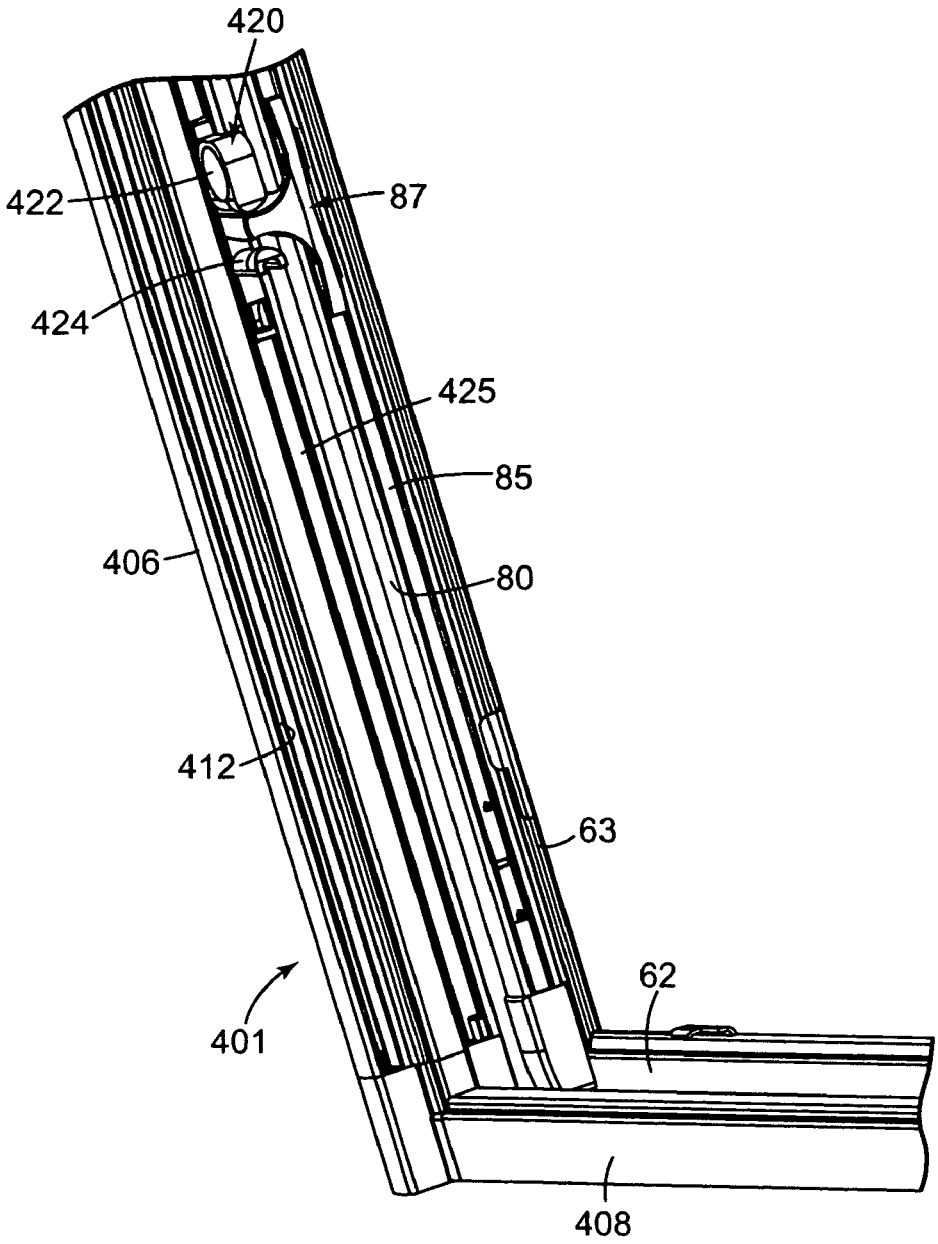
FIG. 21 is a partial detail interior view of the screen and panel combination shown in FIG. 21.
Figure 22:
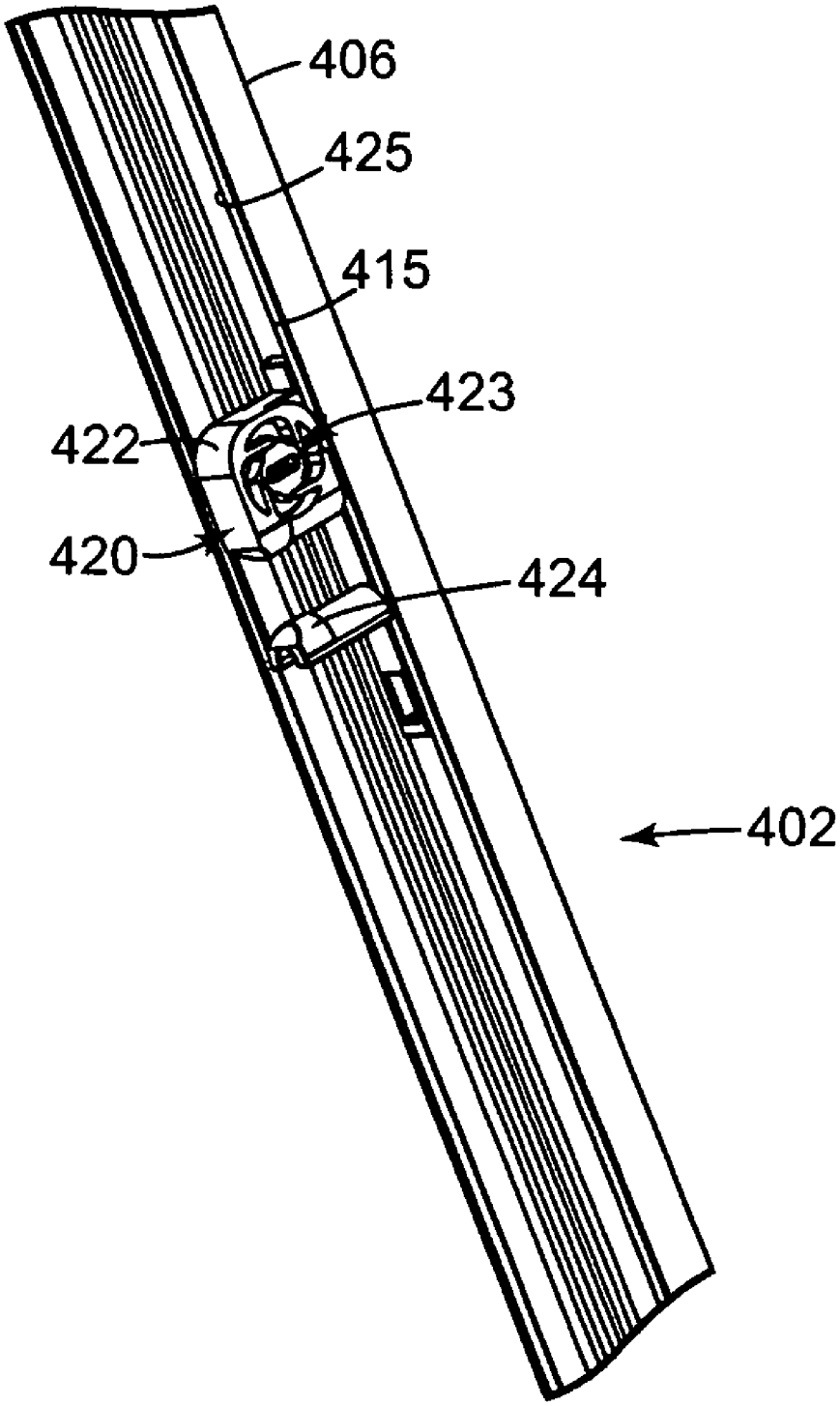
FIG. 22 is a partial detail exterior view of the screen of FIGS. 20 and 21.
Figure 24:
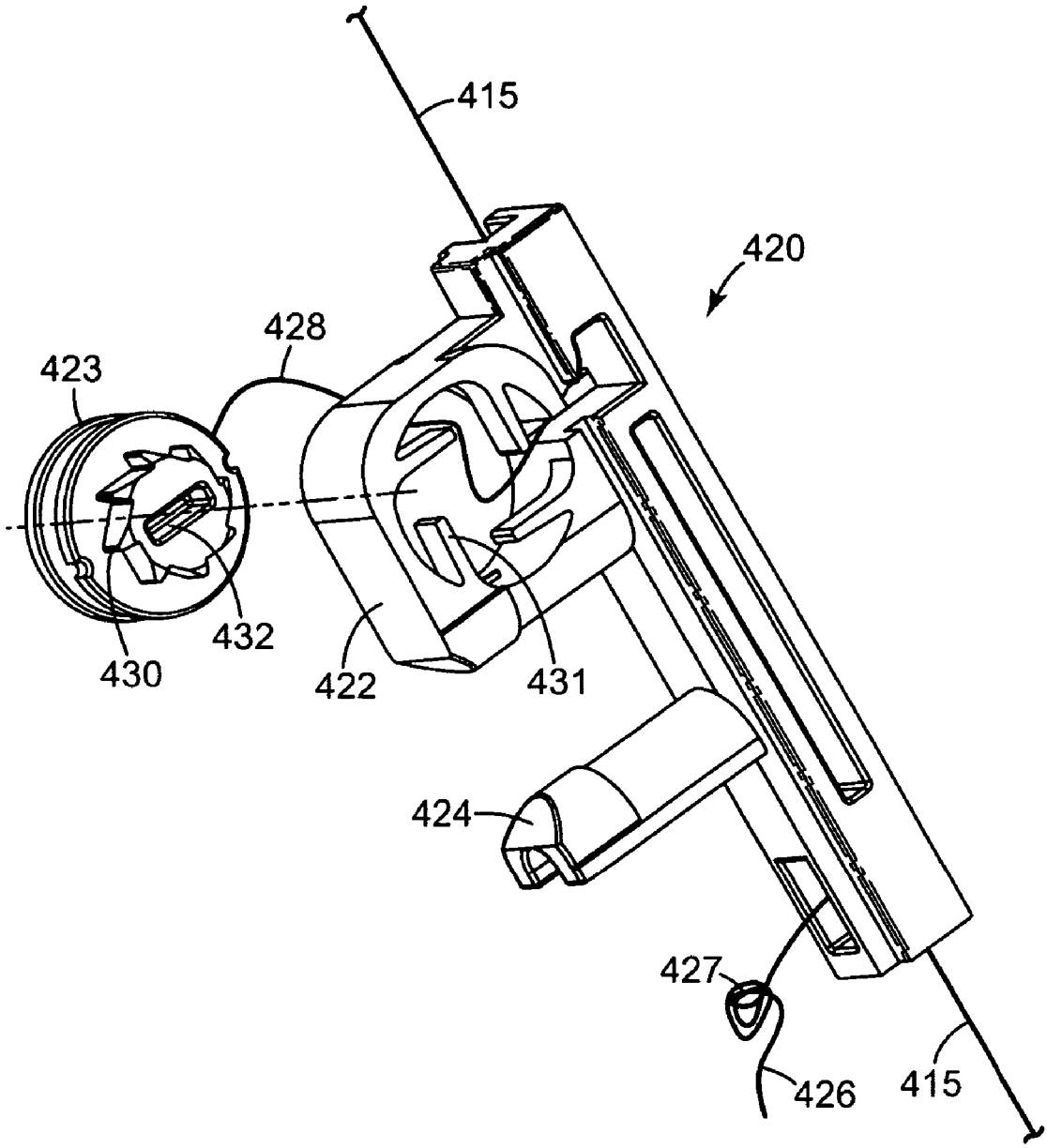
FIG. 24 is an exploded detail view of one embodiment of a coupler, as shown in FIGS. 20–22.

When the screen assembly 400 is positioned against the glass panel 60, the coupler 420 engages slide operator handle 87. As best shown in FIGS. 21 and 24, coupler 420 includes first and second portions, 422 and 424, respectively, between which the handle 87 is interposed upon installation of the screen assembly 400. Thus, movement of handle 411 along slide channel 412 correspondingly moves coupler 420 along coupler channel 425 through drive assembly 414, resulting in lift and tilt operation of the window blind (not shown) by movement of handle 87.

Figure 23:
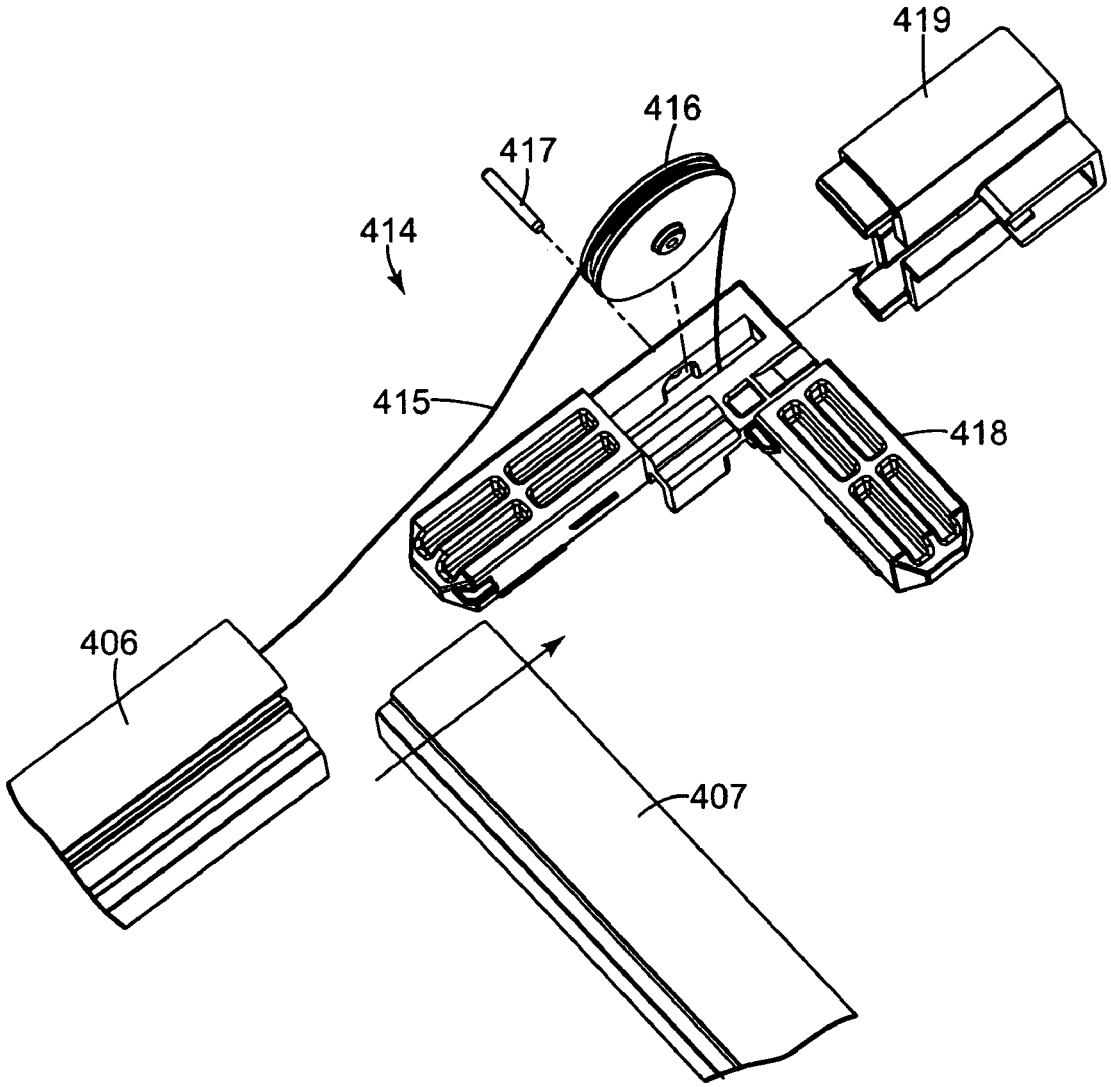
FIG. 23 is an exploded view of one embodiment of a drive assembly usable with the screen sliding operator shown in FIGS. 21–23.

In one embodiment, as shown in FIG. 23, the drive assembly 414 includes a drive mechanism 415, such as a cord, chain, belt, tape, or other suitable device. The drive mechanism 415 is preferably routed about a pulley 416 rotatable about a shaft, pin or other axis 417. In this embodiment, the pulley 416 is housed within a corner coupler 418 holding side member 406 to head member 407. A cap or cover 419 may be included as needed to maintain the pulley 416 within the corner coupler 418 and/or for decorative purposes. The drive mechanism 415 is preferably a continuous loop connected at both ends to the coupler 420.

In one embodiment, shown best in FIG. 24, a first end 426 of the drive mechanism 415 attaches to the coupler 420 with a knot 427 or other suitable fastening device. A second end 428 of the drive mechanism 415 attaches to a tensioner 423 provided within the first portion 422 of the coupler 420. The tensioner 423 is configured with a plurality of teeth 430 that engage with a plurality of corresponding snap ends 431 in first portion 422. The second end 428 is threaded into and secured to tensioner 423, which is then snapped into first portion 422 such that the teeth 430 engage snap ends 431. Rotation of the tensioner 423 within the first portion 422, preferably by use of screw drive slot 432, results in an adjustment to the tension in the drive mechanism 415 so as to maintain adequate control over movement of the coupler 420 and, thus, the handle 87.

The present invention provides numerous advantages over other window covering systems. The present invention includes a number of subsystems, such as the sliding operator, the window covering and the window covering actuation system coupled together by a shaft passing through the glass panel for between-the-glass applications. These subsystems may be decoupled for ease of maintenance, repair, removal, cleaning, etc. The glass panel may be removed from the window sash and frame, with the sliding operator, the window covering actuation system and the window covering being removed along with the panel. Any of these subsystems may thus be dealt with as needed.

In addition, decoupling of the sliding operator from the window covering actuation system at the shaft allows for adjustment/readjustment of the sliding handle position relative to the overall window/fenestration product. In operation, a user may tip the window covering to disengage the shaft from the sliding operator, move the handle to a desired position, and then re-engage the shaft and sliding operator. With the gear reduction built into the sliding operator and window covering actuation system interface, the sliding handle may be repositioned along the length of the sliding channel to accommodate the user's needs. For example, in tall windows, the sliding operator handle may be positioned at the lower end of the channel because the upper end is out of reach of the average user. Alternatively, in doors, the sliding operator handle maybe positioned at the upper range of the channel because it is harder to stoop down low near the floor. For standard windows, on the other hand, it may be desirable to have the handle positioned in the middle of the available range of channel length. With the insect screen sliding operator of the present invention, the range of motion and position of the screen sliding handle may also be readjusted to match the range and position of the sliding operator on the fenestration product.

Fenestration products with adjustable coverings, also known as window coverings, for example those shown and described above, are commonly subjected to various forces that may cause problems with the lift and tilt mechanism. Such forces may result in the window covering becoming jammed or stuck during upward or downward travel. In particular, the lift cord may slacken when the window covering encounters an obstacle or the actuation system is actuated too quickly. Slack in the lift cord may cause it to become disengaged with the winding mechanism and tangle or snarl. Attempts to rectify the situation may additionally cause damage to the lift cords, or other actuation system components. For window coverings mounted between glass window panels, jamming of the window covering and component damage cause further problems because the window covering is not readily accessible by the user for readjustment and/or repair.

Figure 25:
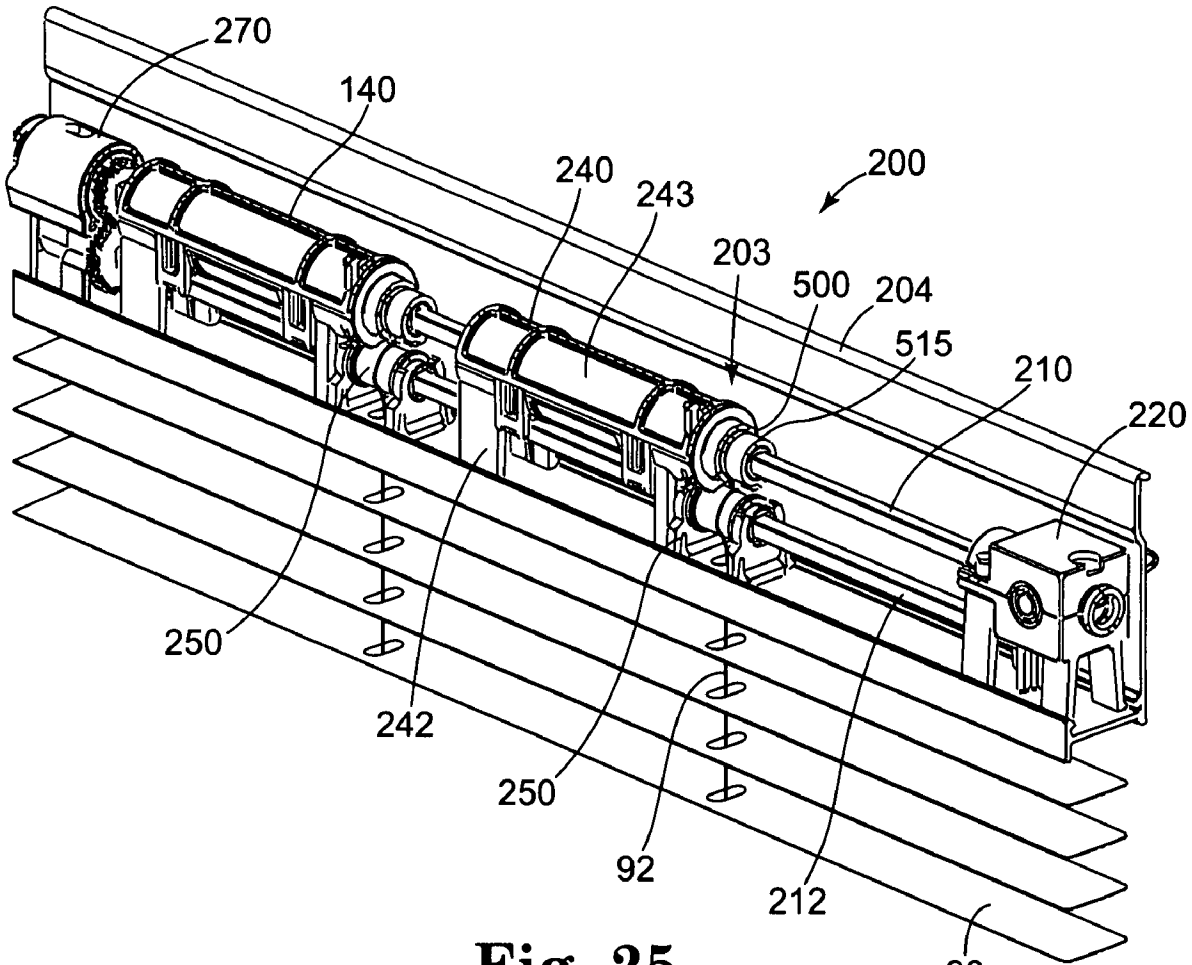
FIG. 25 is an exterior, detail view of another embodiment of a window covering actuation system, including an alternative embodiment of a lift spool drive system.
Figure 26:
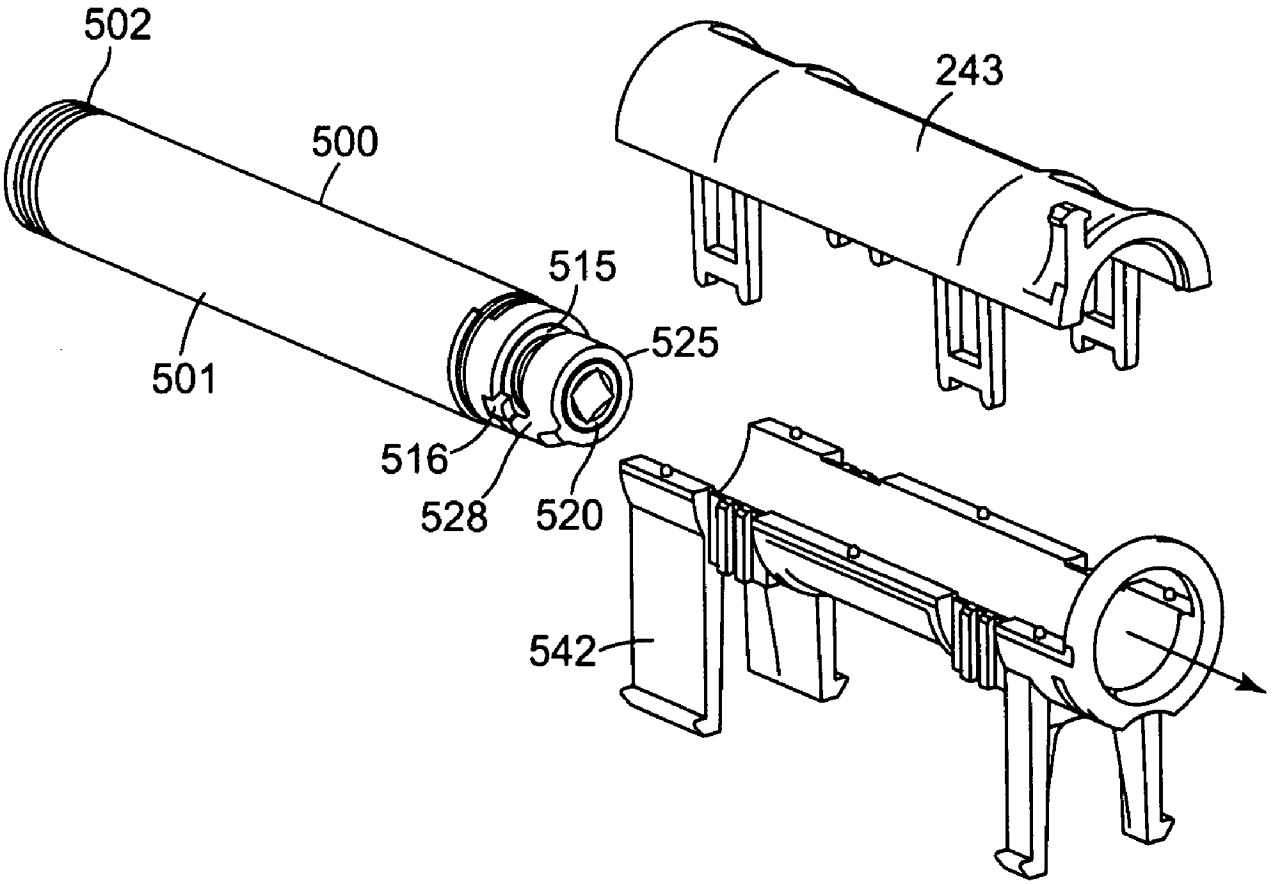
FIG. 26 is a detail view of the lift spool drive system of FIG. 25, shown with a spool shroud and cradle.
Figure 27:
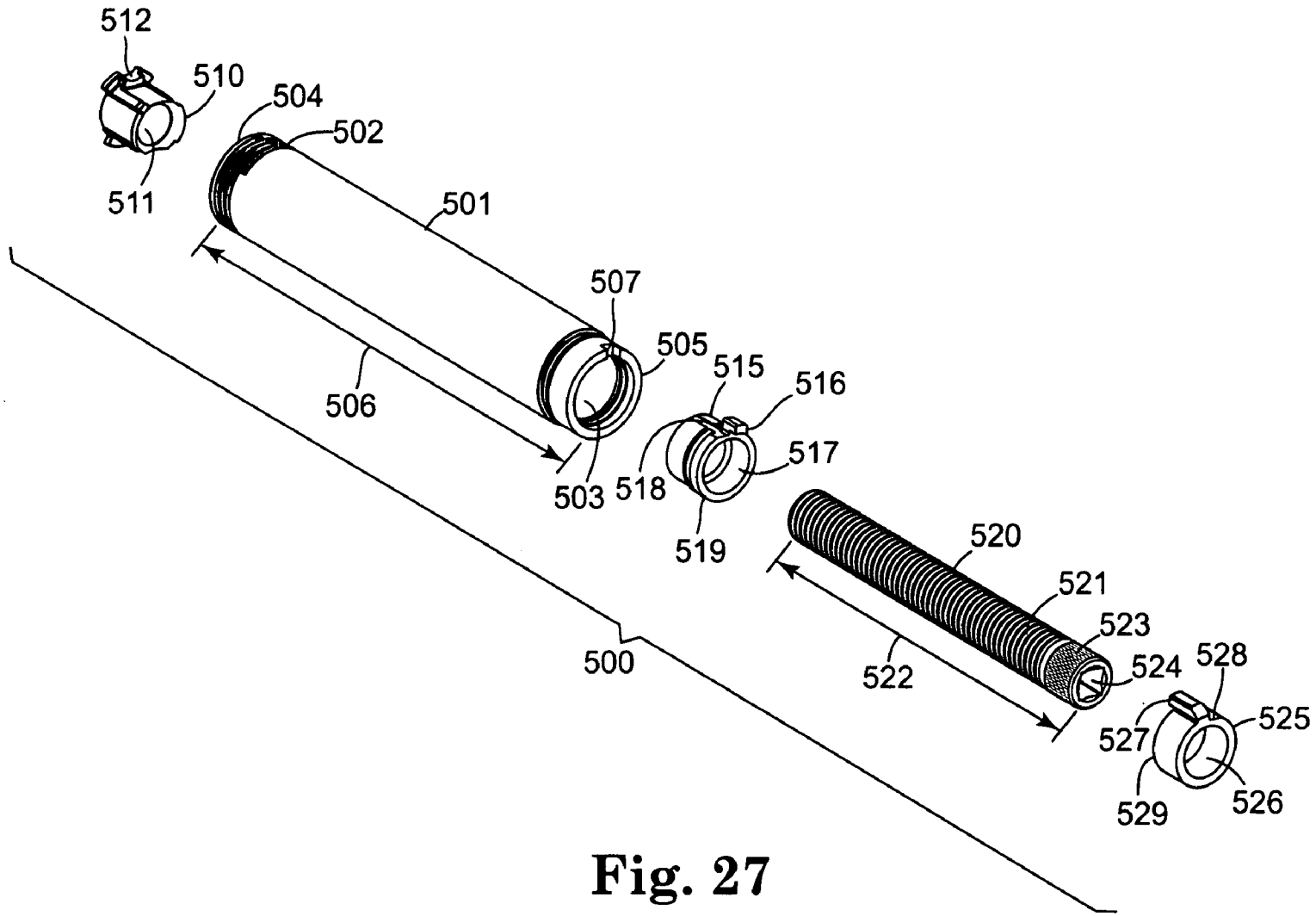
FIG. 27 is an exploded view of the lift spool drive system of FIG. 26.

Referring now to FIGS. 25–27, another view of the window covering actuation system 200 is shown, similar to that shown in FIG. 10. The system 200 includes multiple components 203, including lift shaft 210, tilt shaft 212, gear box 220, and clutch & brake 270. In addition, two lift spool assemblies 240 are mounted to engage the lift shaft 210, and two tilt drum assemblies 250 are mounted adjacent the lift spool assemblies 240 engaging the tilt shaft 212. The lift spool assemblies 240 each include the same or similar protective shroud 243 and support cradle 242.

In this embodiment, however, the lift spool 241 is replaced by a lift spool drive system 500, including a modified lift spool 501. The modified lift spool 501 includes an exterior thread or groove 502 similar to the spiral groove 244. In addition, the modified lift spool 501 includes a hollow bore 503 extending throughout a length 506 the spool 501. A plug 510 is configured to be inserted into a first end 504 of the modified spool 501. The plug 510 has an interior center bore hole 511 extending through it, sized to allow for free rotation of the lift shaft 210 as it passes through the plug 510. In addition, it includes an axially extending notch 512 configured to allow passage of the lift cord 92 while capturing a knot (not shown) at the end of the lift cord 92. This notch 512 also provides a keying function for the plug 510 relative to the spool 501 to ensure angular alignment of the plug 510. In one embodiment, the plug 510 is formed from a polymer, such as an equivalent material to that used for the modified lift spool 501; however, other suitable materials may also be used, as would be known by one skilled in the art.

At a second end 505, the modified spool 501 includes an edge notch 507 configured to mate with a spool stop 516 on a nut 515. The spool stop 516 extends radially from the nut surface, as well as axially from a leading edge 519 of the nut 515. A slightly undercut flat region 518 is formed adjacent the spool stop 516. The nut 515 is received within and adhered to the bore 503, such that it is generally flush with the second end 505, except for the spool stop 516. An interior threaded bore 517 extends through the nut 515, with the interior threads configured to mesh with exterior threads 521 on a drive rod 520. The nut 515 and drive rod 520 are preferably formed from brass or other suitable materials, including but not limited to plastic or zinc die cast construction.

The rod threads 521 extend along a majority of a rod length 522, except for an end region 523. In one embodiment, this end region 523 is preferably knurled, however, a smooth end region 523 may alternatively be provided. The drive rod 520 has an interior bore 524 extending the length 522 of the rod 520. At least a portion of the bore 524 is configured to mate with the lift shaft 210, so that rotation of the lift shaft 210 results in rotation of the rod 520 in either direction. In this embodiment, the bore 524 is generally square in cross-section to accommodate the generally square lift shaft 210, at least in the area of the end region 523.

A stop collar 525 is fitted about the end region 523 of the drive rod 520 by insertion of the end region 523 into an interior through-bore 526 of the stop collar 525. The stop collar 525 is prevented from rotating due to attachment to the rod 520, such as by a press-fit between the collar 525 and end region 523, adhesive or by other suitable methods. A knurled end region 523 aids in securing the stop collar 525 to the rod 520. The stop collar 525 includes a drive stop 527 that extends radially from the outer collar surface, as well as axially from a back edge 529 of the collar 525. A slightly undercut flat region 528 is formed adjacent the drive stop 527. The stop collar 525 is also preferably formed from brass, or from another suitable material.

The drive rod 520 threads into and out of the modified spool 501 upon rotation of the lift shaft 210. In this embodiment, inward movement is caused by clockwise rotation and outward movement is caused by counter-clockwise rotation; however, reversed threads are also possible. Near the clockwise/inward rotational limit of the drive rod 520 into the spool 501, the drive stop 527 of the stop collar 525 encounters the spool stop 516 as the spool stop 516 passes over the flat region 528 on stop collar 525. Rotation of the drive rod 520 relative to the spool 501 then ends, and continuing rotation of the lift shaft 210 in the clockwise direction results in generally simultaneous rotation of both the drive rod 520 and the spool 501.

A reversal in the direction of rotation of the lift shaft 210, that is a change to a counter-clockwise direction in this embodiment, causes a disengagement of the spool stop 516 and drive stop 527. As a result, the lift shaft 210 and drive rod 520 freely rotate with respect to the spool 501, such that the spool 502 is not driven by the lift shaft 210 in a counter-clockwise direction. Another change in rotational direction and movement of the drive rod 520 back to its limit, such that the drive stop 527 and spool stop 516 engage, are required before the lift shaft 210 again drives the spool's rotation.

In operation, the drive rod 520 is preferably at its inward most position with respect to the modified spool 501, such that the drive stop 527 and spool stop 516 are engaged. As the window covering 90 is lifted or opened, the lift shaft 210 rotates clockwise, also rotating the drive rod 520 and modified lift spool 501 causing the lift cord 92 to be wound up about the thread or groove 502 under the shroud 243. As the window covering 90 is lowered or closed, the lift shaft 210 rotates counter-clockwise, releasing the clutch/brake 270 and allowing the window covering 90 to drop under its own weight. As a result, the lift cord 92 unwinds from the modified lift spool 501 causing it to rotate counter-clockwise in conjunction with the rotation of the lift shaft 210. Therefore, the drive rod 520 rotates along with the spool 501 and the drive stop 527 and spool stop 516 remain engaged.

During lowering of the window covering 90, the window covering 90 may encounter an obstruction, such as a loose muntin bar or other object, or the window covering 90 may be operated too quickly, such that slack is formed in the lift cords 92. In other embodiments of the window covering actuation system 200, the continuing movement of the operator causes the lift shaft 210 to continue rotating and the lift spool 241 to also continue rotating. As a result, the lift cords 92 wound around the lift spools 241 get snarled, tangled, jammed and/or otherwise messed up, which may cause permanent damage to the cords or the system. In this embodiment, however, once slack is encountered in the lift cords 92, the modified lift spool 501 stops rotating, but the lift shaft 210 continues to rotate along with the drive rod 520. The drive rod 520 unscrews from the modified lift spool 501 as long as the lift shaft 210 continues to rotate in that direction due to continued operation of the window covering operator. The drive rod 520, as shown in this embodiment, is configured with fine enough threads so that, should a problem be encountered at the top most position of the window covering 90, there are sufficient threads to allow for complete operation of the window covering operator to its lowermost limit on smaller fenestration products or up to five feet (1.52 meters) of travel on larger units. More threads may be provided for larger fenestration products, as desired.

Once the obstruction is cleared or the problem is otherwise resolved, operation of the window covering 90 may proceed. As stated above, reversal of direction of the operator results in reversed rotation of the lift shaft 210, along with the drive rod 520. The modified spool 501 does not start rotating until the drive rod 520 reaches its inward limit and the drive stop 527 engages the spool stop 516. As a result, the angular orientation of the modified spool 501 remains in sync with the other lift spools 501 within the overall actuation system 200, and thus rotation registration between the separate lift spool assemblies 240 is maintained. Therefore, misalignment of the window covering 90 is avoided.

In this embodiment, one way drive of the modified spool 501 is provided by the nut 515 and spool stop 516 working in conjunction with stop collar 525 and drive stop 527. However, it is to be understood that other mechanisms for limiting rotational movement of the drive rod 520 in one direction may also be provided. One alternative embodiment includes configuration of the mechanism with left hand threads for rotation in an opposite direction from the mechanism set forth above. Other embodiments of the mechanism include, but are not limited to, construction of the spool 501, nut 515 and spool stop 516 as one integral unit or single part, and/or the construction of the drive rod 520, stop collar 525 and drive stop 527 as one integral unit or single part. These types of parts may be molded and/or machined. Variations of this same concept are also possible. In addition, other embodiments, in which the spool 501 and drive rod 520 interconnect for coordinated rotation in one direction, yet are separate for independent rotation in an opposite direction, are within the skill of those in the art and are covered by this invention.

The lift spool drive assembly of the present invention provides the benefit of resolving a problem frequently encountered with window covering operation, while fitting within the confines of the current actuation system. In particular, in actuation systems provided for between-the-glass window coverings, the available envelope of space for the components of the actuation system is very limited. Therefore, the provision of a mechanism for resolving this problem is most useful and efficient if it is confined to the provided space and does not extend beyond the existing actuation components. In addition, when used with between-the-glass window coverings having the sliding operator, as described above, the tilt function of the window covering may be operated without raising or lowering the covering at its lower limit of travel. When the window covering reaches its lower limit, continuing movement of the sliding operator results in disengagement of the drive screws from the lift spools and permits the operator handle to travel in either direction without raising or lowering the shade.

Although generally described with respect to between-the-glass window covering products, use of the present invention is not limited to between-the-glass window coverings units, but may used and benefit other type of window covering configurations. For example, the overall height tolerance of a window covering is much greater when the present invention drive system is used, since there is no negative consequence to continued operator handle movement after the window covering reaches the lower limit of the glass. This improves the manufacturability of the window covering and/or fenestration product because the window covering length becomes less critical and could be made a little longer than conventionally would be provided to account for variables in the manufacturing process, such as the uncertain effective spring constant of pleated shade material, for example.

All of the patents and patent applications disclosed herein, including those set forth in the Background of the Invention, are hereby incorporated by reference. Although the present invention has been described with reference to preferred embodiments, workers skilled in the art will recognize that changes may be made in form and detail without departing from the spirit and scope of the invention. In addition, the invention is not to be taken as limited to all of the details thereof as modifications and variations thereof may be made without departing from the spirit or scope of the invention. Thus, the scope of the present invention should not be limited to the structures described in this application, but only by the structures described by the language of the claims and the equivalents of those structures.

What is claimed is:

1. A covering system used with a fenestration product comprising:

an adjustable covering;

a covering actuation system configured to extend and retract the adjustable covering upon operation of a covering operator, to provide varying amounts of viewing coverage through the fenestration product, the covering actuation system comprising:

a lift mechanism adapted to couple to the covering operator such that operation of the covering operator results in the extension and retraction of the adjustable covering by action of the lift mechanism; and a drive system configured to temporarily decouple the lift mechanism from the covering operator in response to a potentially damaging event during extension of the adjustable covering.

2. The covering system of claim 1, wherein the potentially damaging event comprises slack in a lift cord during extension of the adjustable covering.

3. The covering system of claim 1, wherein the lift mechanism comprises at least two rotationally synchronized lift mechanisms coupled to the operator that extend and retract the adjustable covering, such that rotational registration between lift mechanisms is maintained upon recoupling of the lift mechanisms to the operator.

4. The covering system of claim 1, wherein the adjustable covering comprises a lift cord coupled to a covering leveling mechanism.

5. The covering system of claim 1 comprising a cord adjuster configured to adjust a length of the lift cord with respect to the covering actuation system.

6. The covering system of claim 1 wherein the adjustable covering is mounted to the fenestration product.

7. The covering system of claim 1 comprising a sliding operator coupled to the lift mechanism to operate the adjustable covering.

8. The covering system of claim 1 comprising an insect screen mountable in the fenestration product, the insect screen having a frame and a screen operator that couples to the covering operator to extend and retract the adjustable covering.

9. The covering system of claim 1 wherein the adjustable covering is located between two sheets of viewing material on the fenestration product.

10. The covering system of claim 1 wherein the adjustable covering is mounted to a glass panel.

11. The covering system of claim 10 comprising a sliding operator on the glass panel coupled to the lift mechanism to operate the adjustable covering.

12. The covering system of claim 10 wherein the sliding operator is coupled to lift mechanism by a shaft extending through at least one sheet of viewing material in the glass panel.

13. The covering system of claim 10 wherein the glass panel is attachable to the fenestration product.

14. A method of operating a covering system used with a fenestration product comprising the steps of:

coupling a lift mechanism to a covering operator;

operating the covering operator to extend and retract the adjustable covering by action of the lift mechanism to provide varying amounts of viewing coverage through the fenestration product; and temporarily decoupling the lift mechanism from the covering operator in response to a potentially damaging event during extension of the adjustable covering.

15. The method of claim 14 comprising the step of adjusting a length of a lift cord with respect to the covering actuation system.

16. The method of claim 14 comprising attaching the adjustable covering to the fenestration product.

17. The method of claim 14 comprising the step of:

attaching an insect screen to the fenestration product; and coupling a screen operator on the insect screen to the covering operator to extend and retract the adjustable covering.

18. The method of claim 14 comprising locating the adjustable covering between two sheets of viewing material on the fenestration product.

19. The method of claim 14 comprising mounting the adjustable covering to a glass panel.

20. The method of claim 19 comprising coupling a sliding operator on the glass panel to the lift mechanism to operate the adjustable covering.

21. The method of claim 19 comprising attaching the glass panel to the fenestration product.

22. The method of claim 14 comprising coupling the covering operator to the lift mechanism by a shaft extending through at least one sheet of viewing material in the glass panel.

* * * * *